US006224497B1

(12) United States Patent
Antonious

(10) Patent No.: US 6,224,497 B1
(45) Date of Patent: May 1, 2001

(54) GOLF CLUB HEAD WITH IMPROVED FREQUENCY MATCHED BALL STRIKING FACE CHARACTERISTICS

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

(21) Appl. No.: 09/285,464

(22) Filed: Apr. 2, 1999

Related U.S. Application Data

(63) Continuation-in-part of application No. 08/937,169, filed on Sep. 25, 1997, now abandoned.

(51) Int. Cl.[7] ..... A63B 53/04

(52) U.S. Cl. ..... 473/330; 473/331; 473/340; 473/342; 473/345

(58) Field of Search ..... 473/324, 330, 473/331, 340, 341, 342, 350, 345, 251, 238, 252, 219, 329; D21/736–752

(56) References Cited

U.S. PATENT DOCUMENTS

D. 63,284 * 11/1923 Challis .
D. 193,098 * 6/1962 Davis .
2,034,936 * 3/1936 Barnhart .
4,529,203 * 7/1985 Ribaudo .
4,530,505 * 7/1985 Stuff .
4,792,140 * 12/1988 Yamaguchi .
4,869,508 * 9/1989 Miller .
5,354,059 * 10/1994 Stuff .
5,505,450 * 4/1996 Stuff .
5,766,087 * 6/1998 Kawamatsu .

* cited by examiner

*Primary Examiner*—Sebastiano Passaniti
(74) *Attorney, Agent, or Firm*—Aquilino, Welsh & Flaxman

(57) ABSTRACT

The present invention relates to an improved golf club head having a ball striking face with vertical grooves and intermediate vertical land areas between the grooves. The club head includes a resonator system having specific resonant frequencies which are determined by the specific variable width and depth combinations of vertical grooves and specific variable widths of the land areas between the vertical grooves. This controls the harmonics and feedback of a golf club head when it is used to stroke or strike a ball. In accordance with the invention, having more land area between the vertical grooves, creates a lower frequency resonance when striking a golf ball resulting in more energy transfer to the ball from a greater surface contacting the ball. Having less land area where the vertical grooves are closer together, creates a higher frequency resonance and somewhat less energy is transferred to a golf ball struck by the club head, thereby providing a softer feel. In addition, the variable depths and widths of the vertical grooves are used to control the resonance. Deeper and wider vertical grooves create a lower resonance and conversely narrow shallow vertical grooves create a higher resonance on the respective club heads.

33 Claims, 18 Drawing Sheets

FIG. 1
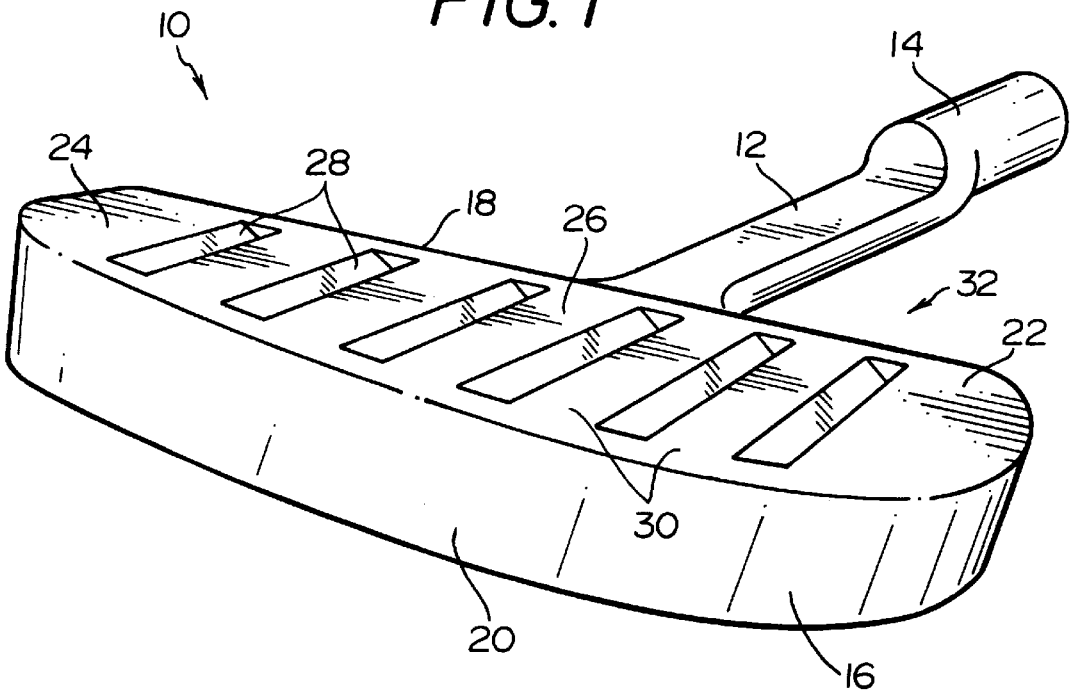
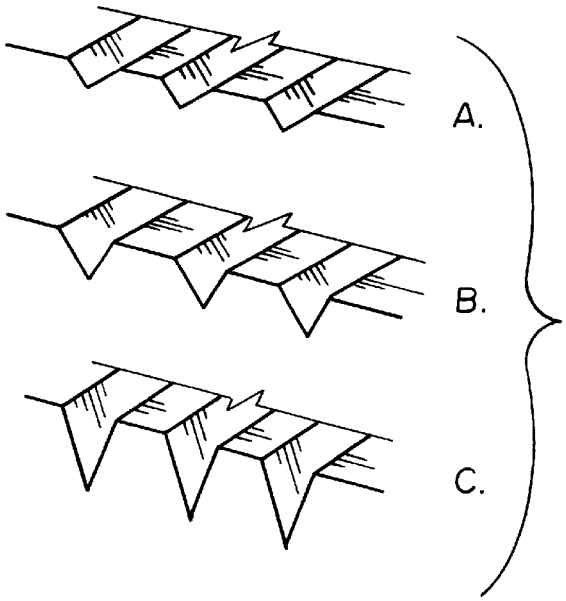
FIG. 2

FIG. 4
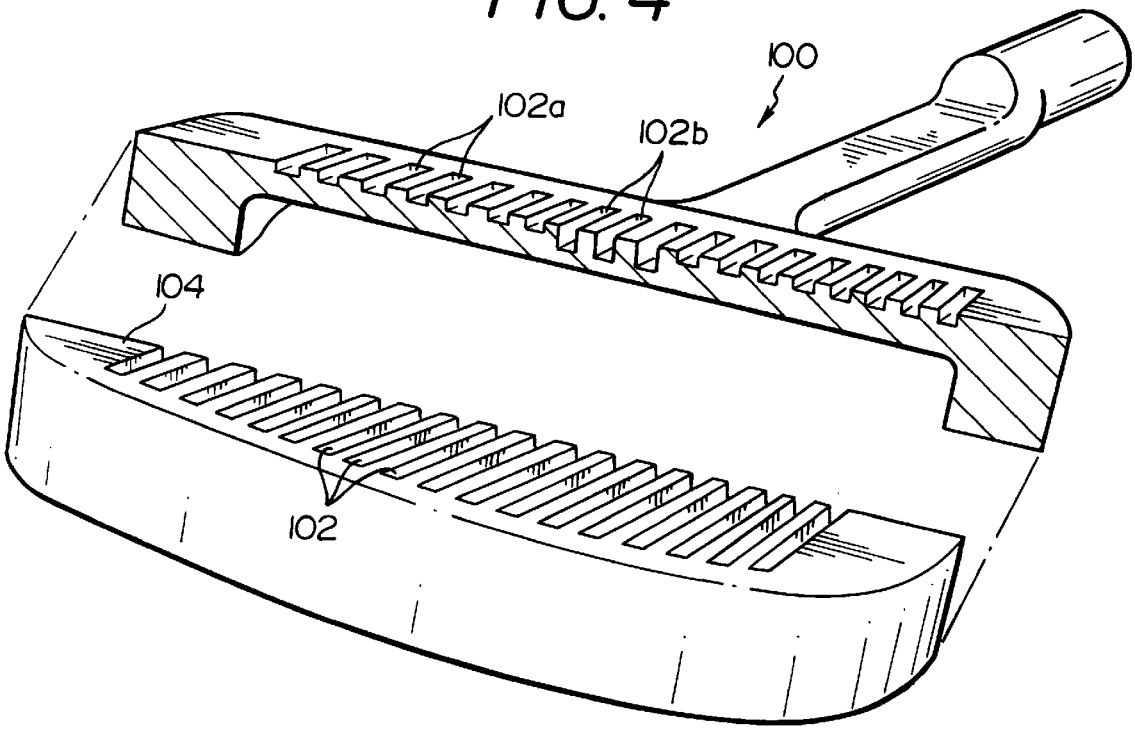
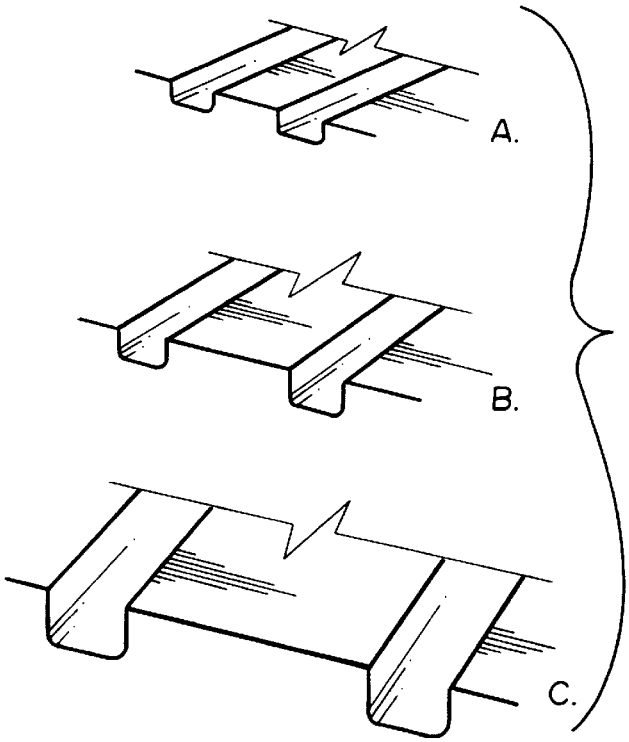
FIG. 3

FIG. 15
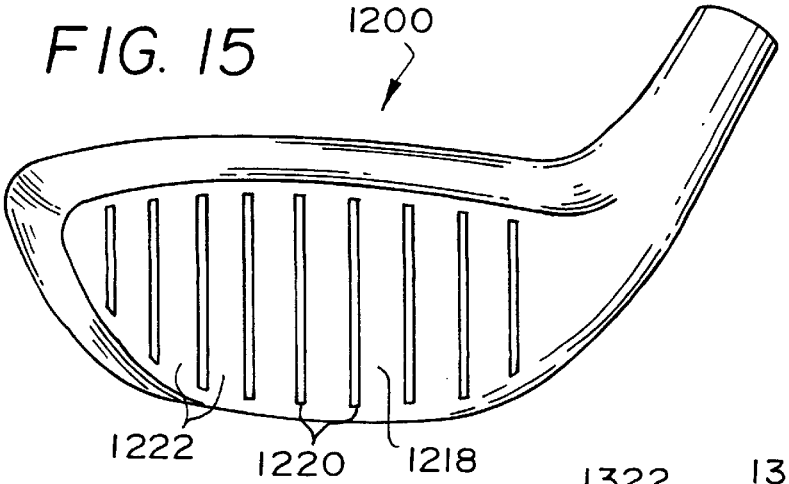
FIG. 16
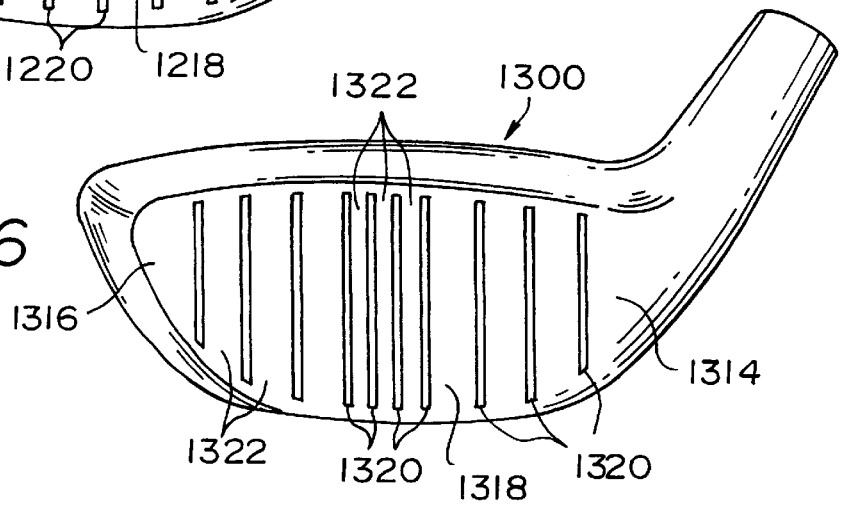
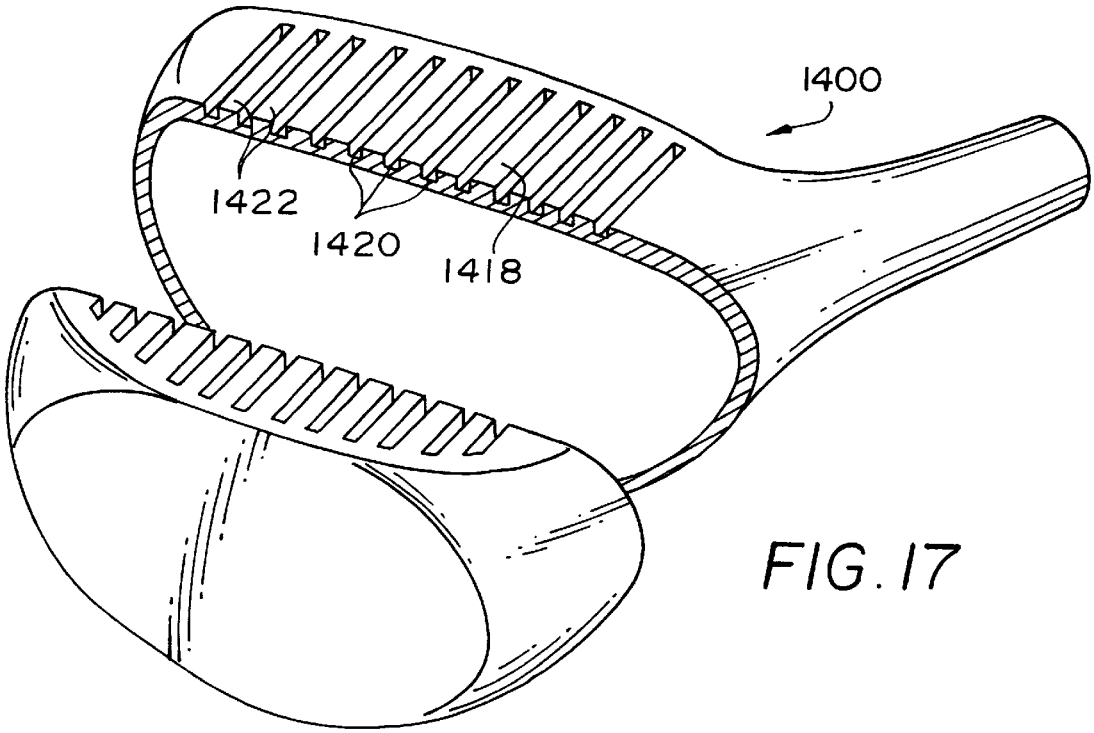
FIG. 17

FIG. 18
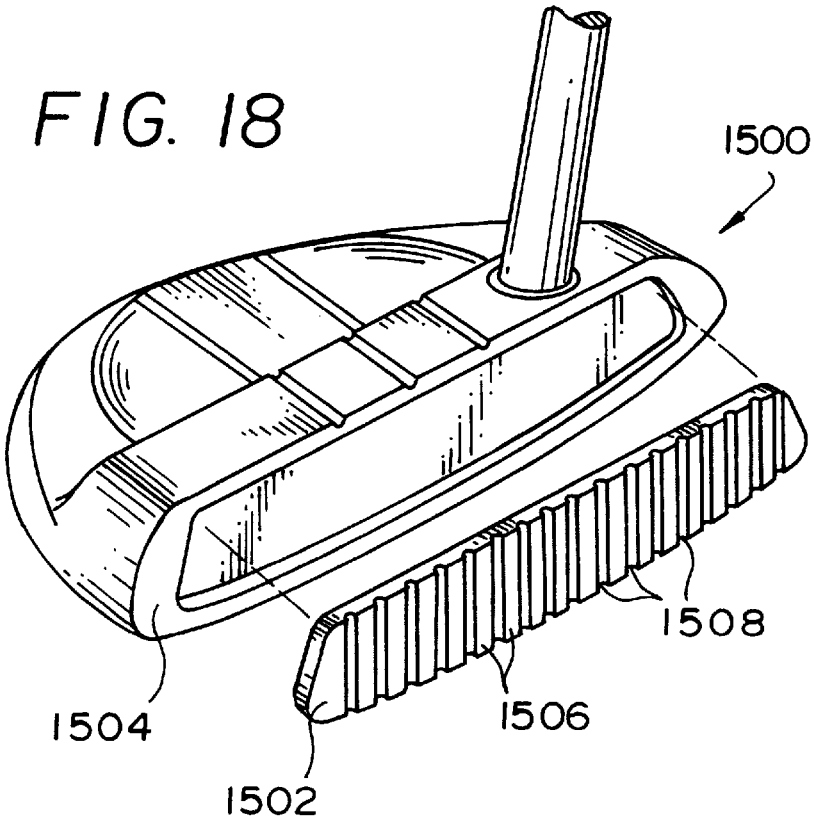
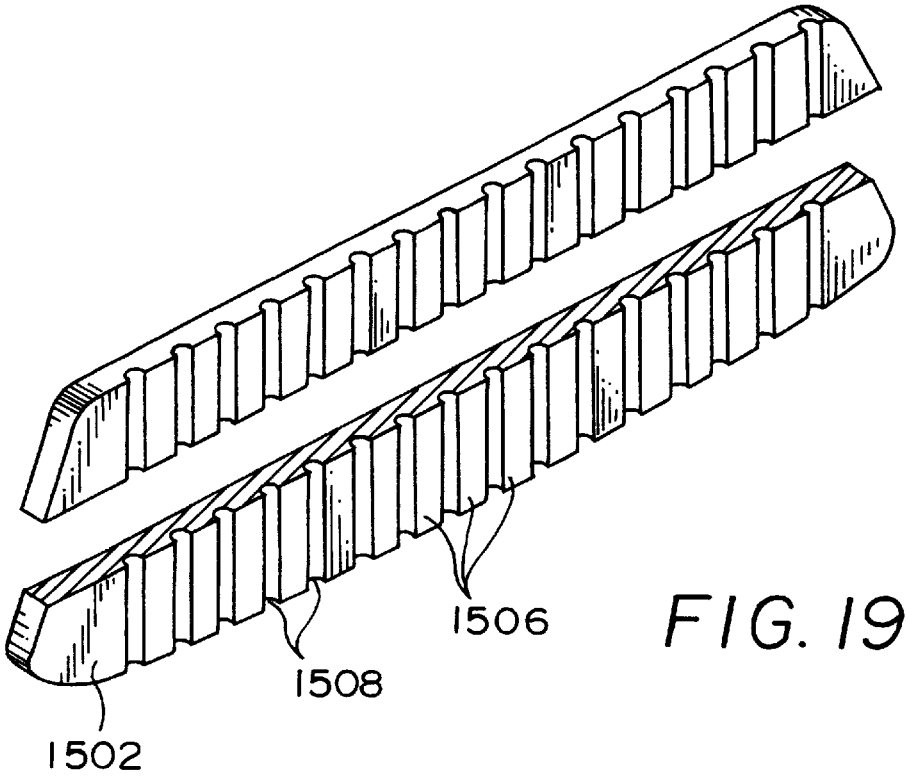
FIG. 19

FIG. 24
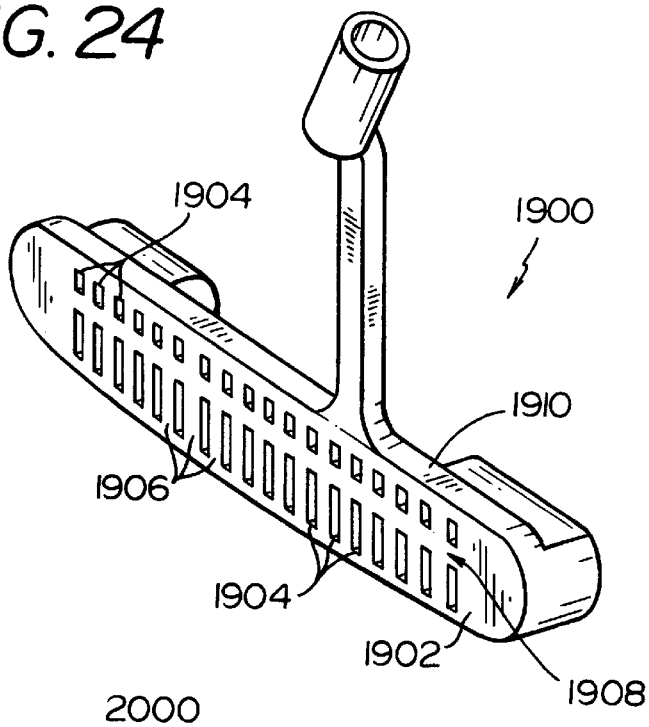
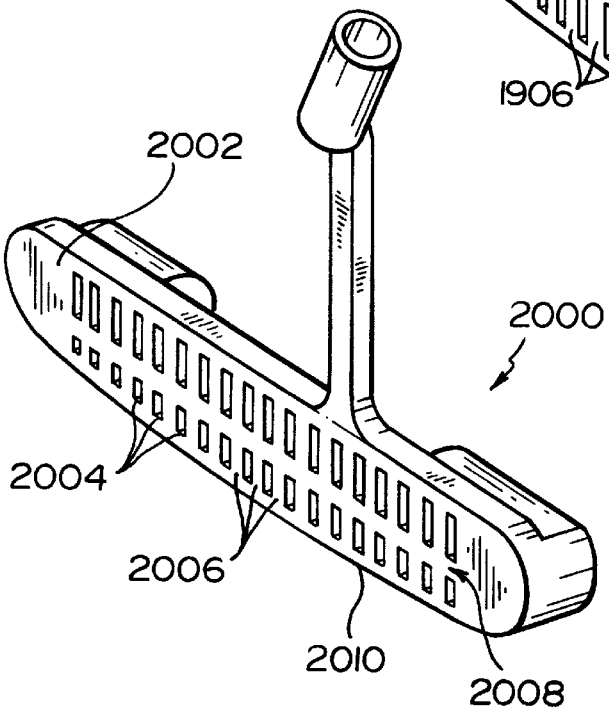
FIG. 25
FIG. 26
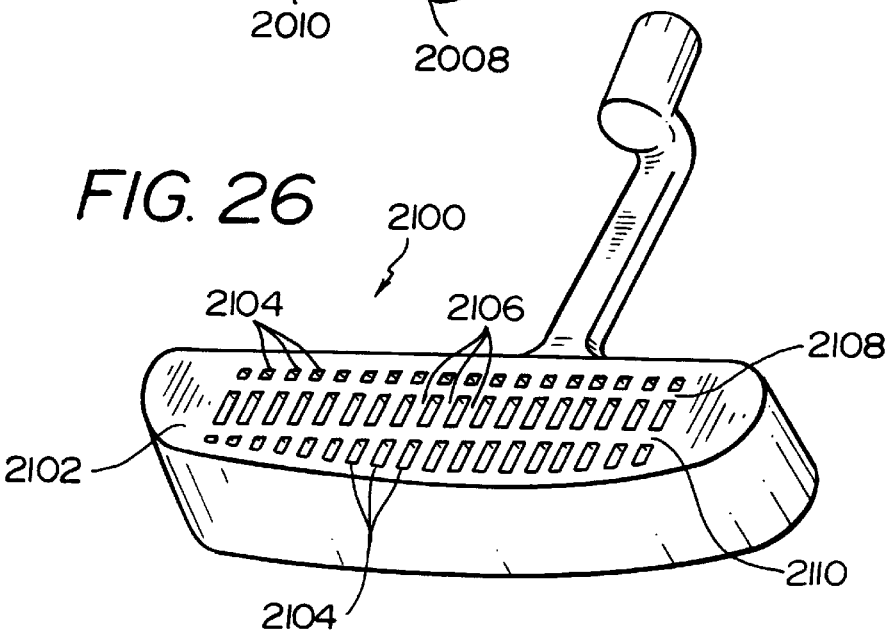

FIG. 27
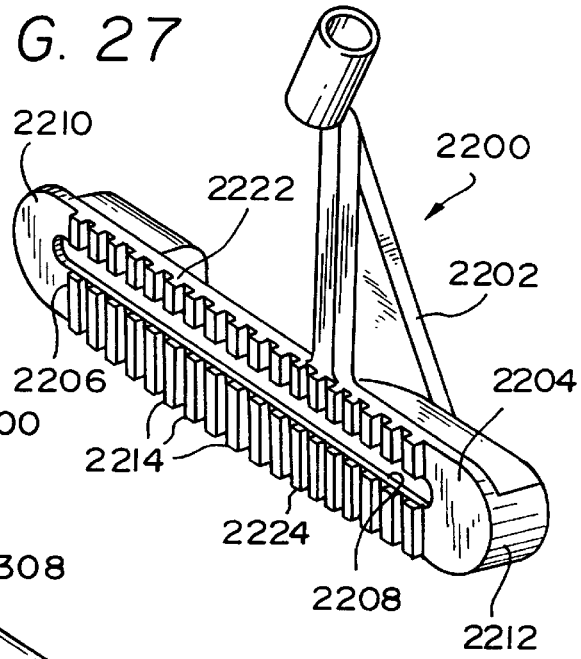
FIG. 28
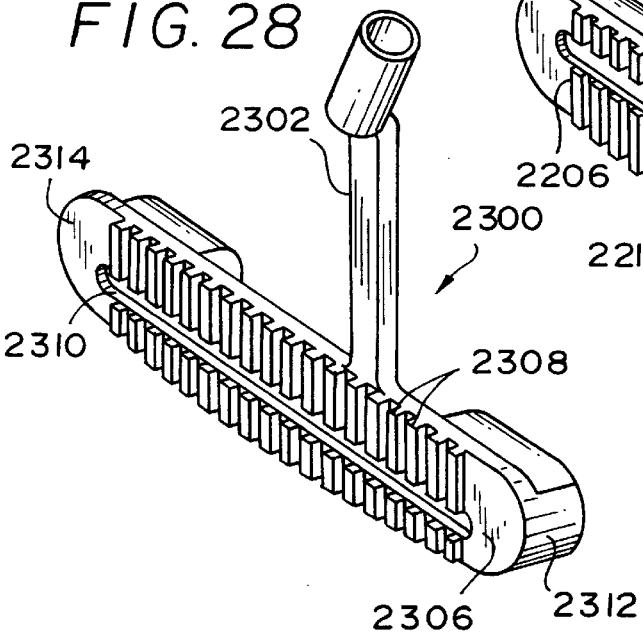
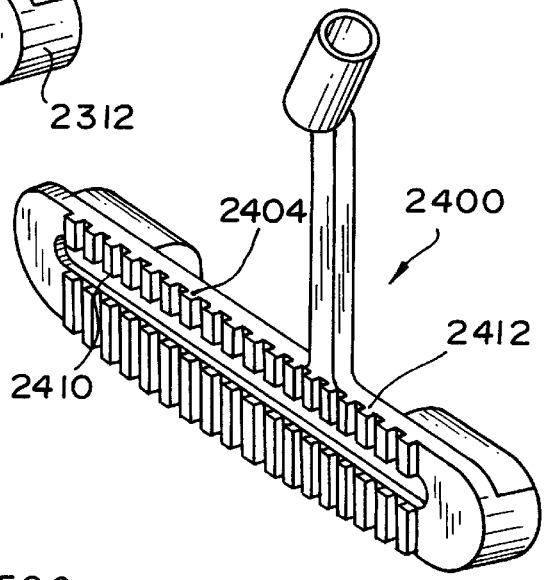
FIG. 30
FIG. 29
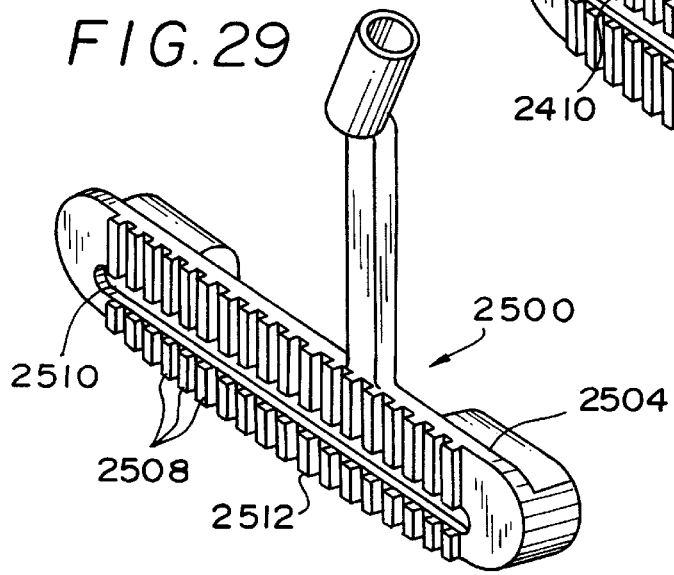

FIG. 41
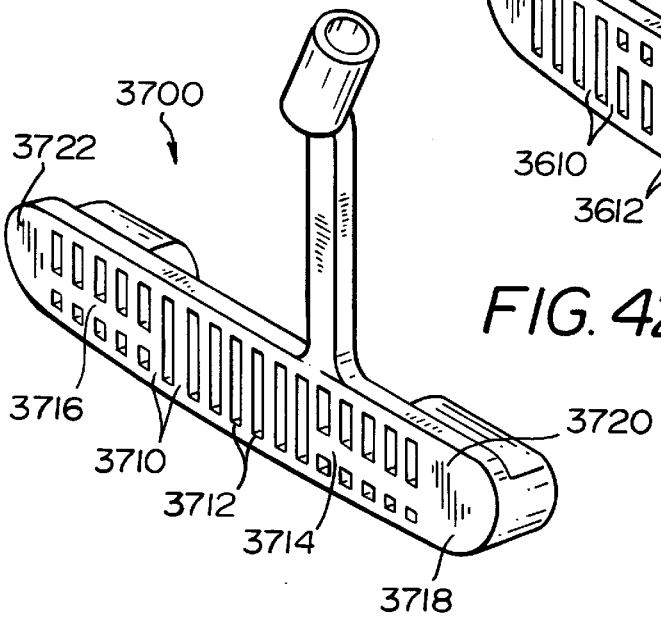
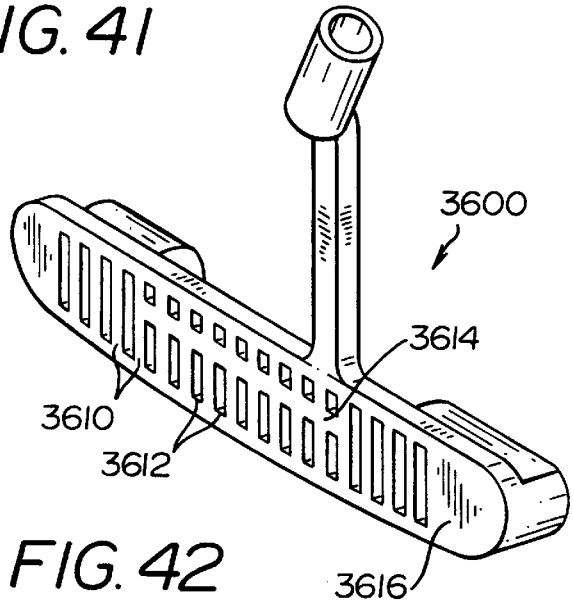
FIG. 42
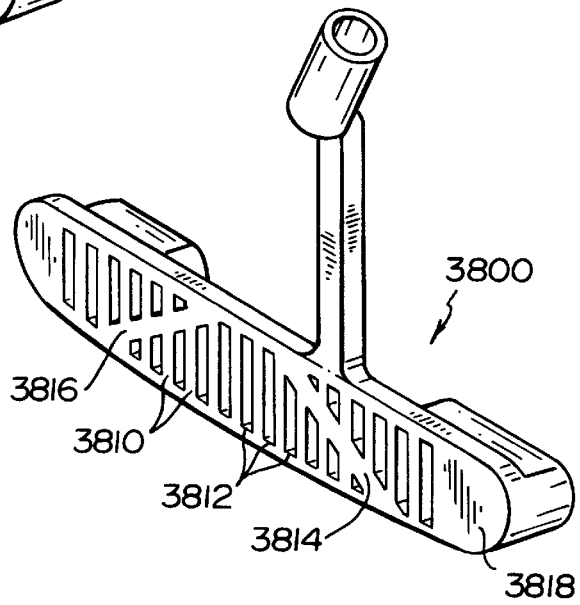
FIG. 43
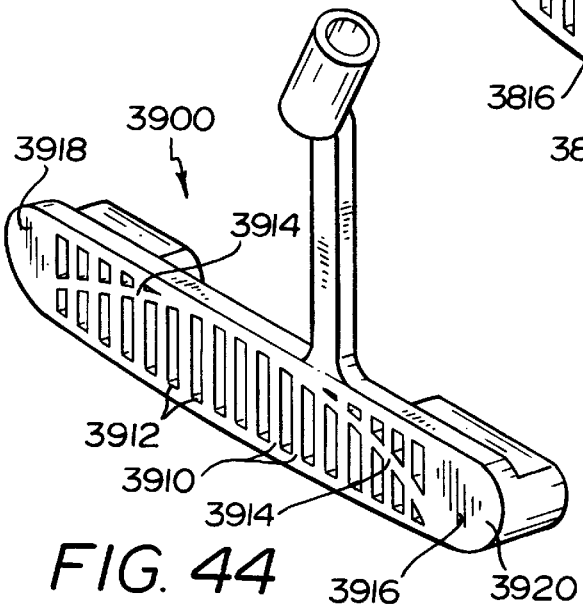
FIG. 44

GOLF CLUB HEAD WITH IMPROVED FREQUENCY MATCHED BALL STRIKING FACE CHARACTERISTICS

RELATED APPLICATION

The present application is a continuation-in-part of Ser. No. 08/937,169, filed Sep. 25, 1997 entitled GRID CONFIGURATION FOR GOLF BALL STRIKING FACE, now abandoned.

BACKGROUND AND SUMMARY OF THE INVENTION

The present invention relates to golf club heads and, in particular, to improved golf club heads having a plurality of vertical grooves, preferably with "frequency-matched" ball striking face configurations.

Conventional golf clubs, such as woods and irons, as well as putters, have been provided with grooves forming land areas and other shaped indentations, on the ball striking face, in order to control the spin and direction, as well as the feel, of a golf ball being struck by the particular golf club. Most iron and wood type clubs have used horizontal groove configurations in a heel-to-toe direction in a pattern of U-shaped or V-shaped grooves. U-shaped grooves have two opposing surfaces, each at 90° to the ball striking face. V-shaped grooves are angled to form a V-configuration with respect to the ball striking face.

Prior art configurations of interest are shown in a number of U.S. Patents. For example, U.S. Pat. No. 4,530,505 to Stuff shows a golf putter club head with wide vertical grooves on the ball striking face extending from the top ridge to the bottom surface.

U.S. Pat. No. 5,505,450 to Stuff shows, in FIGS. 7 and 8, a putter having a groove configuration wherein the grooves generally converge toward the longitudinal center of the club head in the direction of the top surface and diverge away from the longitudinal center of the club head in the direction of the sole surface.

British Patent No. 25564, 1905, shows a putter type golf club head with vertical grooves which extend all the way from the bottom sole to the top surface of the ball striking face.

U.S. Pat. No. 2,034,936 to Barnhart shows, in FIG. 9, a golf club having a plurality of transverse slots which extend completely through the club head from the front to the rear side.

U.S. Pat. No. 1,854,548 to Hunt shows a golf club head with vertical grooves on the rear and extending through the club head. U.S. Pat. No. 1,289,533 to Sanders shows an iron type golf club head with a horizontal raised groove, which is sawtooth or triangular in cross-section.

Another patent of interest is U.S. Pat. No. 1,532,545 to Peterson, which shows a curved ball striking face with a sawtooth groove configuration.

U.S. Design Pat. No. 63,284 to Challis shows a putter configuration including horizontal and vertical grooves, which form series of square or rectangular land areas on the ball striking face.

Still another prior art ball striking face structure is disclosed in the September 1998 issue of GOLF MAGAZINE, page 94 which describes a putter with a series of nubs which project outwardly from the putter face to grip a golf ball when it is struck by the putter to impart a softer feel to the golfer's hands.

In addition to groove configurations, many putter faces are currently made with face inserts of various materials, which are softer and provide a solid feel and an improved responsive sensation when putting a golf ball. However, such putters are generally more complex to produce and, consequently, are more expensive than standard conventional putters. Also, the ball striking faces of many currently marketed iron and metalwood type club heads include face inserts made of a variety of materials, other than the "basic" single stainless steel material used to produce the main club heads. Such face insert materials include titanium, beryllium copper, zirconium, nickel, bronze, manganese, and a variety of other blended alloy materials suitable for golf clubs.

The primary purpose of some of the prior art club face configurations are directed mainly to "imparting corrective or specific action to a golf ball", or "achieving a variety of different actions to a golf ball struck by the face". Some rely on plurality of grooves "extending along the face in non-parallel directions or with pads or both." Also they include "means for imparting a desired action along the club face" having a resilience greater than the material used to produce the club head.

The entire golf industry has moved rapidly into hi-tech to market their respective products that are better designed to dramatically improve the golfing skills and enjoyment for all golfers. For example, golf club shaft makers have expanded the use of frequency-matched shaft technology that offer a variety of flexing, rigidness and recovery characteristics, that best suit each golfer, regardless of age, gender or physical abilities. The frequency-matched technology for golf club shafts creates shafts that produce better feel, increased accuracy and distance, less vibration and undesirable shocks.

Also the ongoing fierce competition in the golf ball industry compels the golf ball manufacturers to perpetually utilize the most sophisticated new component materials and availability of hi-tech equipment improvements, with their latest new technology in making golf balls that are best suited for each class of golfers and conform to the rules of golf. The combinations of components, such as the various types and sizes of inner cores, are frequency-matched to the various types of outer coverings, such as Balata, Surlyn and other materials, specifically blended to provide the best performing balls, most suitable for each caliber of golfer.

The leading golf ball manufacturers have been concentrating on producing a new breed of balls. Their advanced technology is producing balls with different types of cores, combined with variety of outer cover materials, having combinations of aerodynamic dimple designs. The dimples in the outer-ball covers include a variety of different shapes and sizes, and have been combined to produce a particular ball-cover design, specifically to greatly increase ball-flight control and accuracy. (This improvement alone has increased the overall performances of at least five golf balls with different compression ranges [70 to 100+]). Just as important, are the substantial improvements that have been made to the basic inner cores of the balls. Generally, the cores are round spheres made from steel, Titanium, solid rubber, rubber wound or other fluid-filled contained means. These are used to produce 3-piece wound Balata balls, 2-piece Surlyn cover balls and even 1-piece solid-core-and-cover golf balls. All of these advanced hi-tech improvements have been combined to dramatically increase their respective distances and overall performances . . . they offer a better, more desirable, audible harmonic and sensual feedback that produces the preferred "click" and enhanced solid sensations. These are the preferred features that are felt even when stroking a putted ball or striking a ball, with high velocity swings using iron and metalwood club heads to reach greater distances.

The ongoing challenge that the golf ball industry constantly faces, is not only to make a better ball than their competitors, but also to make it within the rigid parameters to conform to the rules of golf as defined and established by the U.S.G.A.

Likewise, the vertical groove concept of the present invention, is uniquely adaptable and very practical for use on all golf club heads, particularly since all of the golf club heads can be fine-tuned by having various combinations of coordinated, precision, frequency-matched, ball striking club face configurations. The vertical grooves are formed with variable precisely sized widths and depths that are adjacent properly sized land areas, also having coordinated widths, to produce the preferred results for all caliber of golfers. The vertical groove concept, for fine-tuning the respective golf club heads, relies on various combinations of precisely sized and shaped frequency matched configurations on the ball striking club faces to create the preferred feel and sound and performance for club heads, such as putters, irons, and woods. For some embodiments, this can be accomplished without using a second material, such as face inserts.

Various musical instruments use strings and wires, such as violins, guitars, banjos, pianos, and so forth, to produce different sounds. They rely on the different thickness and length of their strings or wires to repeatedly produce the desired resonance and preferred harmonic qualities when properly used. The present invention preferably provides preferred resonance and harmonic qualities, for a particular club and its application.

The feather at the end of an arrow helps to stabilize the shaft by resisting twisting and minimizing other undesirable movements, upon release while airborne and traveling toward it target. Similarly, the borings in the barrel of a gun help to stabilize the bullet as it leaves the muzzle to propel it in a practically straight-line trajectory to its target.

There is some comparison between the behavior of an arrow and a bullet and the concept of the present invention. The vertical grooves on the club faces of the present invention have a beneficial effect on the ball and tends to generate a forward top spin traction producing a straight-line trajectory. Having only vertical groove face configurations, the vertical groove concept of this invention minimizes adverse direction such as exaggerated slicing or hooking and produces a low trajectory boring ball flight with top spin and increased distance. The ball also lands softly. This concept does not impart adverse spin like the prior art.

The club face configurations are created by an array of shorter vertical grooves and shorter vertical land areas, formed in a perpendicular direction to the ball striking face, rather than the much longer array of horizontal grooves formed on traditional golf club heads. In the preferred embodiments, the uniquely structured frequency-matched configurations formed on the ball striking faces utilize combinations of specifically predetermined dimensions, best suited for the isolated vertical land areas and or the coordinating adjacent vertical grooves. The various coordinated combinations of both, extend perpendicularly to the club face, but generally do not extend into or beyond the top or bottom outer surfaces of the club face.

The land located between the vertical grooves meet with longitudinal planar land areas, located adjacent the top ridge and bottom sole of the club head, together with the properly coordinated vertical grooves and surrounding land areas, to form a grid that produces preferred harmonic and resonant characteristics, such as a specific frequency when ball contact occurs on the club face.

The specifically designed structure of the preferred configurations on the club faces, closes-off both end-portions of the vertical grooves on the ball striking face of putters, irons and metalwood club heads. This "corralled" energy requirement as described below, is critical to obtaining and maintaining the most proficient and desired matching frequency of the club face to achieve the superior performance and success of the invention. In addition, the dynamic force transferred to the club face must be contained and controlled, even for fractions of a second, to minimize and prevent the energy available from being totally dissipated, when ball contact occurs. It is paramount to trap and harness as much energy, at the moment of ball impact and at the precise point on the club face, where ball contact is made. This will permit a greater amount of energy created to be retained and be immediately available and transmittable, directly to the ball, upon contact. Since the shorter combination of various precision sized vertical grooves effectively isolates the variably-sized and coordinated vertical land areas on the club face, this concept permits the unique frequency-matched club face configurations to produce the unusual feel and preferred harmonics resulting in the superior performances for all golf club heads with this invention.

This invention relies on test data, accumulated from successfully applied extensive research and development knowledge, experimentation and relentless testing, to produce the impressive and formidable results in the present invention.

The extraordinary performance of the frequency-matched vertical grooves concept for club faces of all golf club heads, is supported by one of nature's phenomena that involve the laws of physics and dynamics. This is revealed and visually established in a very simple related demonstration of nature's phenomena.

When a pebble or golf ball lands in a pond of water, it instantly produces a rippling effect on the surface. A pattern of concentric circles or rings are formed immediately upon the pebble or ball striking the water's surface. This clearly demonstrates that the energy level of the force at impact is evenly distributed, mostly laterally, and radiating outwardly in a 360° direction at the water's surface, dissipating as the force or energy level diminishes equally in every direction. This phenomenon of nature also reveals other startling facts. The concentric ripples are symmetrically shaped, evenly spaced, and their outward flowing-pace is even controlled so that no ripple overtakes another. This phenomenon of one of nature's wonders never deviates from its repeating, precisely-regulated performance, no matter where or how often it occurs. This display of the laws of dynamics indicates that a given force, at impact, is evenly distributed, unimpeded, in all directions, but predominantly along a smooth or planar surface. These revealing facts relating to the laws of dynamics, along with the "fire break" or "fire gap" proven techniques used by professional firefighters to fight devastating forest fires, are combined to create the novel and practical concept of the disclosed invention, uniquely applicable for producing completely new types of frequency-matched club faces on all types of golf club heads.

The first prototype club heads tested established superior, different breed of high-performing club heads for all caliber of golfers. It was determined that variable sized vertical grooves on the club faces of the high-velocity swung iron club heads, will impart little, if any, backspin to the ball, like the horizontal grooves on traditional golf club heads. However, the ball has a slightly lower initial trajectory and yet farther carry, when struck by club heads of the present invention with vertical grooves. This is due to minimal, if any, backspin that can be produced by the traditional horizontal grooves. On the other hand, with the lower flight pattern of golf balls struck with frequency-matched club faces having vertical grooves, the ball landed softer and with increased stop action, on the green, but without the unpredictable effect from the degree of backspin produced by horizontal grooves.

The configuration of vertical grooves on club faces not only dramatically improves the feel and responsiveness, but also substantially reduces the negative effects from shocks and vibrations and other adverse results from mis-hits, thin shots and fat shots, particularly when ground contact occurs behind the ball. With the present invention, balls track straighter and go farther, especially against strong headwinds or unmanageable severe crosswinds.

Mis-hits, on club faces with horizontal grooves, can cause diverse shock waves and vibrations to be much more noticeable. This occurs because the shock waves and vibrations travel laterally along the recessed channels, formed by the elongated horizontal grooves on the club faces of traditional club heads, directly to the hosel, up the shaft, and to the gripping hands of the golfer.

These undesirable effects are practically eliminated when using club heads with the shorter vertical grooves of the present invention on their faces. The specifically designed vertical grooves and coordinated land areas act as buffers, impeding and effectively restricting the adverse shock waves and vibrations from moving laterally, as they do in the horizontal grooves of traditional golf club heads. Consequently, any force or energy distributed from the club face at impact, will tend to travel only the shorter distance upwardly and downwardly through the vertical grooves at the impact zone. This concept effectively alters and/or eliminates any of the harsh forces incurred at impact, that travel horizontally to, and up through, the hosel and up the shaft to the gripping hands of traditionally-used clubs.

Also, there is a more noticeable, much softer feel when impacting different quality balls, regardless if they are the softer covered Balata balls or the harder covered Surlyn balls. Golf balls fly straighter and farther when struck by iron or wood type club heads having such club faces with vertical grooves. Balls hit with club faces having frequency-matched vertical grooves have a more consistent flight pattern and trajectory, whereby ballooning is reduced considerably, if not eliminated. Furthermore landing is softer, especially on greens, with minimum forward movement and, of course, with practically no backspin. Also, making ball contact towards the toe or heel portions of the club faces with such vertical grooves, does not severely penalize the shot; rather the ball stays in play with minimum or no loss of distance.

SUMMARY OF THE INVENTION

The present invention relates to an improved golf club head having a ball striking face using variable sized and shaped combinations of vertical grooves and coordinated land vertical spaces between the vertical grooves, to create a predetermined harmonic relationship between the grooves and spacings which, in turn, controls the feel of a golf club when it is used to strike a ball. The grooves preferably do not extend all of the way to the top and bottom of the club head. In effect, there are horizontal lands adjacent the top and bottom of the head. As explained below, in some embodiments the club heads also include a horizontal or inclined land at the middle area of the club head, to further restrict and control the harmonic and energy transferring effect of the vertical grooves and lands. It will be appreciated that the terms vertical and horizontal are relative to the position of the club head relative to the ground or support surface, when the club head is soled to hit the ball.

For the purpose of the present invention, the term vertical is defined relative to a golf club head on a support surface in position it would normally assume at address just prior to the execution of a golf shot. For example, when using a putter, a vertical direction is the direction perpendicular to the putting green surface at address and during the execution of a putting stroke. A vertical direction is further defined as the direction generally perpendicular to a longitudinal line extending in a heel to toe direction and to the top and bottom surfaces of the club head, it being appreciated that a golf club head is not precisely rectangular in shape but includes a number of curved surfaces.

In accordance with the invention, having more land areas between the vertical grooves, a lower resonance or frequency of vibration occurs when striking a golf ball and, in turn, more energy is transferred to the ball because of the greater surface which contacts the ball. When less land area is provided, that is, where the vertical grooves are closer together, a higher resonance or harmonic frequency occurs and a different energy transfer occurs when a golf ball is struck, thereby providing a softer feel. In addition, the widths of the land areas and the widths and depths of the vertical grooves are combined to create and control the preferred resonances. Deeper and wider vertical grooves combined with variable land area widths create a lower resonance, and conversely shallower and narrower vertical grooves create a higher resonance. In the preferred embodiments, the width of the vertical lands between the grooves on iron and wood club heads is approximately three times the width of the vertical grooves.

The various size and shape combinations of the vertical grooves and the land areas create different feel and sound characteristics. Ideally, the invention permits a specific feedback vibrational "click" -sensation or harmonic relationship which can be created to satisfy every golfer or at least several different general types of golfers. For example, a golfer who wishes a softer feel to the golf club head would choose a club head having a vertical groove and land area combination configuration with a high resonance, whereas a golfer who wanted greater energy transfer for a given stroke would choose a golf club head having a coordinated vertical groove and land area combination which produces a lower resonance.

TABLE OF PREFERRED COORDINATED DIMENSIONS TO PRODUCE VARIABLE HARMONICS AND SENSUAL FEEDBACKS (In Thousandths of an Inch)

| | Vertical Grooves for: | | Land Areas for: | |
|---|---|---|---|---|
| | Iron and Wood Heads | Putter Heads | Iron and Wood Heads | Putter Heads |
| Widths | Less than 0.035 | Variable Range from 0.010 up to 0.060 | 3 x width of Vertical Grooves | Variable Range from 0.020 to 1.000 |
| Depths | Less than 0.020 | Variable Range from 0.010 up to 0.060 | -0- | -0- |

Among the objects of the present invention is the provision of using coordinated vertical groove and land area combinations on the ball striking face which allows a golfer to selectively determine the preferred sound and performance characteristics of the golf club head.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view of a putter type golf club head in accordance with the present invention.

FIG. 2 shows three different combinations of grooves used with the present invention.

FIG. 3 shows three additional versions of grooves used with the present invention.

FIG. 4 is a perspective view of a second embodiment of putter type golf club head in accordance with the present invention shown partially in section.

FIG. 15 is a front elevational view of a second embodiment of a wood type golf club head in accordance with the present invention.

FIG. 16 is a front elevational view of a third embodiment of wood type golf club head in accordance with the present invention.

FIG. 17 is a perspective, sectional exploded view of a fourth embodiment of a wood type golf club head in accordance with the present invention.

FIG. 18 is a front perspective, exploded view of an alternate embodiment of a putter type golf club head in accordance with the present invention.

FIG. 19 is an exploded sectional view of a detail of FIG. 18.

FIG. 24 is a front perspective view of a tenth embodiment of a putter of the present invention.

FIG. 25 is a front perspective view of a eleventh embodiment of a putter of the present invention.

FIG. 26 is a front perspective view of a twelfth embodiment of a putter of the present invention.

FIG. 27 is a front perspective view of a thirteenth embodiment of a putter of the present invention.

FIG. 28 is a front perspective view of a fourteenth embodiment of a putter of the present invention.

FIG. 29 is a front perspective view of a fifteenth embodiment of a putter of the present invention.

FIG. 30 is a front perspective view of a sixteenth embodiment of a putter of the present invention.

FIG. 41 is a front perspective view of a twentieth embodiment of a putter in accordance with the present invention.

FIG. 42 is a front perspective view of a twenty-first embodiment of a putter in accordance with the present invention.

FIG. 43 is a front perspective view of a twenty-second embodiment of a putter in accordance with the present invention.

FIG. 44 is a front perspective view of a twenty-third embodiment of a putter in accordance with the present invention.

DESCRIPTION OF THE PREFERRED EMBODIMENTS

Figure 5:
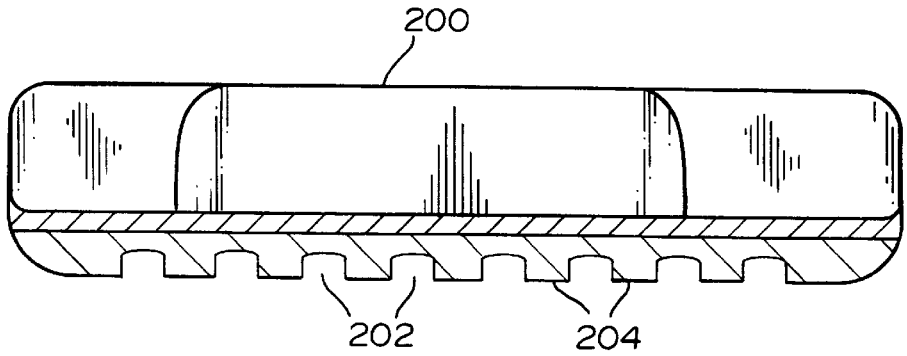
FIG. 5 is a top plan view, partially in section, of a third embodiment of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to FIG. 1, a putter type golf club head 10 including a hosel 12 and shaft socket 14, is connected to a club head body 16 having an upper surface 18, lower surface 20, heel 22 and toe 24. The club head body 16 includes a ball striking face 26 having an array of vertically disposed grooves 28, that is, the grooves 28 and land areas 30 formed between the grooves 28 are perpendicular to the upper surface 18 and lower surface 20 of the club head body 16. As shown, the grooves 28 do not extend to the top and bottom of the club head. Thus, the club head in effect includes horizontal lands on the club face adjacent the top and bottom. The combination of the structure of the grooves 28 and the land areas 30 forms a resonator system 32 having given frequency resonance as a result of the vibrational impact when the club head 10 is used to strike a golf ball. The frequency of the resonance is determined by the dimensional relationship between the grooves 28 and land areas 30 and their length. That is, the frequency of the resonance is determined by the size, shape and spacing of the grooves 28 relative to the land areas 30. In this preferred embodiment, the grooves 28 are shallow, V-shaped grooves and are separated by wide land areas 30.

Referring to FIG. 2, various groove configurations A, B and C are disclosed. Groove A is a shallow V-shaped groove. Groove B is an intermediate depth V-shaped groove. Groove C is a deep V-shaped groove. FIG. 3 illustrates a variety of U-shaped grooves that can be applied to the present invention. Groove A is a shallow U-shaped groove, Groove B is an intermediate depth U-shaped groove, and C shows deep U-shaped grooves.

It will be appreciated that a variety of the V-shaped or U-shaped grooves may be used on the ball striking face of the golf club head in accordance with the present invention. Furthermore, the grooves may be spaced close or further apart creating gradually larger or smaller land areas depending upon the resonance characteristics which are desired. For instance, the spacing between the vertical grooves may progressively and symmetrically increase from the center of the club head to the heel and toe, much like the ripples made by a drop of water on a pond. This will produce vertical land areas that progressively increase in width, from the center outwardly. Similarly, the width of the grooves can increase in the same manner.

It will be appreciated that a wide variety of combinations may be used whereby a golfer may individually select a golf club head that provides a superior feel for the golfer's particular swing characteristics. Preferably, the land areas between the edges of adjacent grooves for putter heads are variable in the range of 0.020–1.000 inches. Given a groove that is 0.035 inches wide and has a depth of 0.020 inches, the land areas would be at least 0.105 inches wide, specifically for iron and wood type club heads.

FIG. 4 illustrates a second embodiment of a putter type golf club head 100 in accordance with the present invention including an array of grooves 102 on the ball striking face 104 as shown in the sectional view. In this embodiment, the outer grooves 102a are shallow U-shaped grooves, whereas the grooves 102b at the center of he club head body are deep U-shaped grooves 102.

FIG. 5 illustrates a third embodiment of a putter type golf club head 200 using wide and deep U-shaped grooves 202. The grooves 202 have the same width and depth and also the same width of the land areas 204 between the grooves 202.

Figure 6:
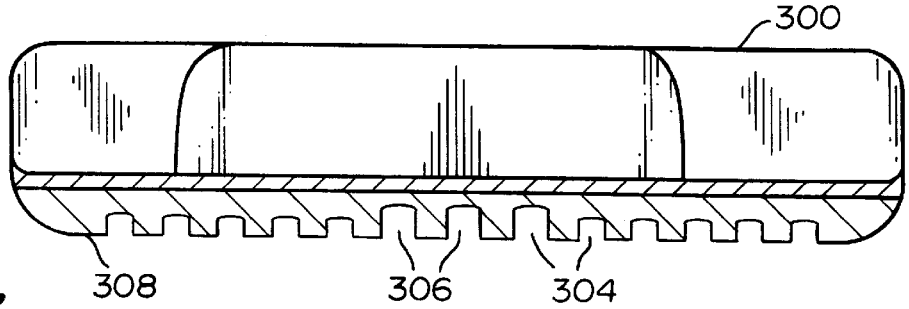
FIG. 6 is a top plan view, partially in section, of fourth embodiment of the present invention.

FIG. 6 shows a fourth embodiment of a putter type golf club head 300 which includes variable width and depth of U-shaped grooves 304, the largest grooves and deepest 306 being centrally located on the ball striking face 308.

Figure 7:
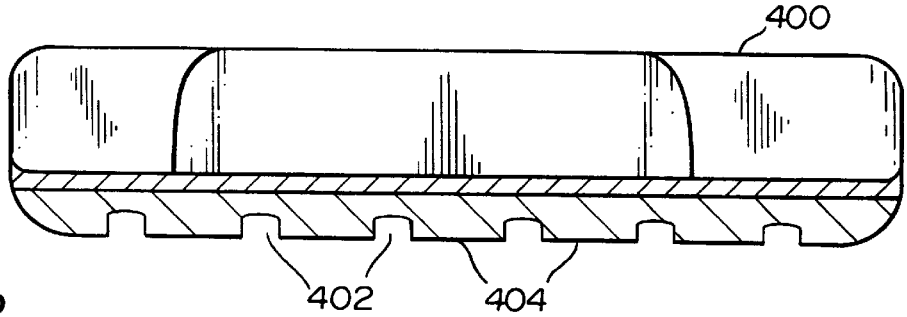
FIG. 7 is a top plan view, partially in section, of a fifth embodiment of the present invention.

FIG. 7 shows a fifth embodiment of a putter type golf club head 400 having an array of U-shaped vertical grooves 402 that have the same width and depth but with land areas 404 between the grooves that are at least three times the width of the groove 402.

Figure 8:
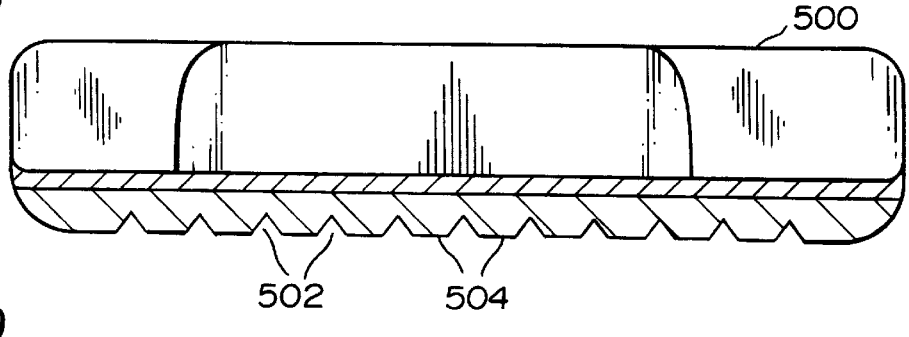
FIG. 8 is a top plan view, partially in section, of a sixth embodiment of the present invention.

FIG. 8 illustrates a sixth embodiment of a putter type golf club head 500 having an array of V-shaped vertical grooves 502 having the same width and depth and the same width land areas 504.

Figure 9:
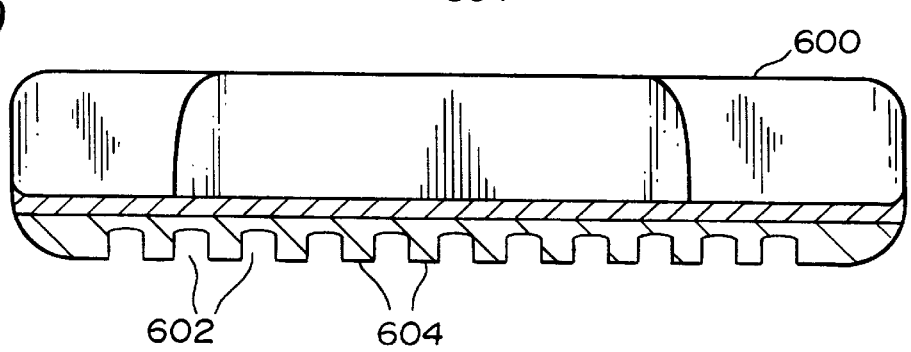
FIG. 9 is a top plan view, partially in section, of seventh embodiment of the present invention.

FIG. 9 is a view of a sixth embodiment of a putter type golf club head 600 having an array of U-shaped vertical grooves 602 with the same width and depth and the same width as land areas 604. The grooves 602 are smaller than the embodiment shown in FIG. 5

Figure 10:
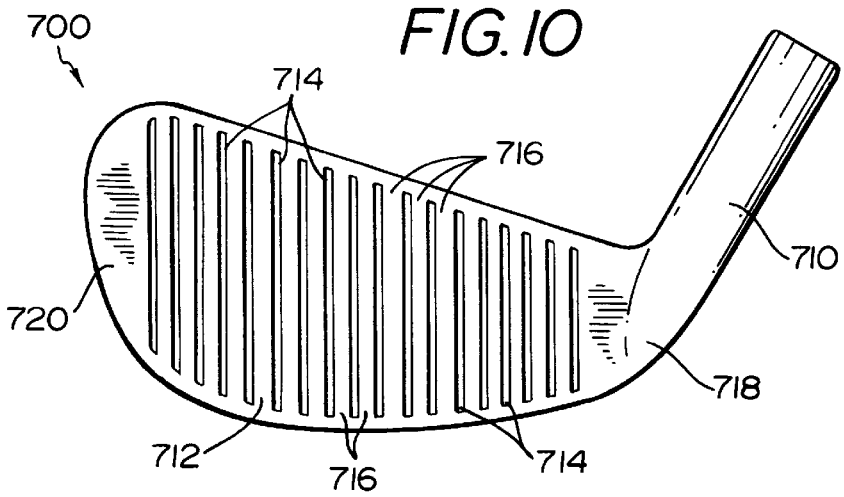
FIG. 10 is a front elevational view of an iron type golf club head in accordance with the present invention.

FIG. 10 is a first embodiment of an iron type golf club head 700 including a hosel 710 and a ball striking face 712 having a array of coordinated vertical grooves 714 equally spaced and adjacent to and between cooperating land areas 716 having relatively narrow widths across the length of the ball striking face 712 between the heel 718 and toe 720. The ends of the vertical grooves do not extend into the top and bottom of the club face. Instead they terminate at the horizontal sections of the land areas 716 located adjacent the top and bottom portions of the club face 712. The horizontal sections of the lands 716 of the present invention preferably are sufficiently large and strong to stabilize the vertical lands 716. The vertical sections of the land areas 716 thus in effect are elongated bands of strings that are connected and fixed to the horizontal land sections located at the top and bottom of the club face and have a particular resonance or harmonic frequency. Also, this structure of the vertical grooves and land areas provide additional cushioning at impact, especially for iron and wood type club heads.

Figure 11:
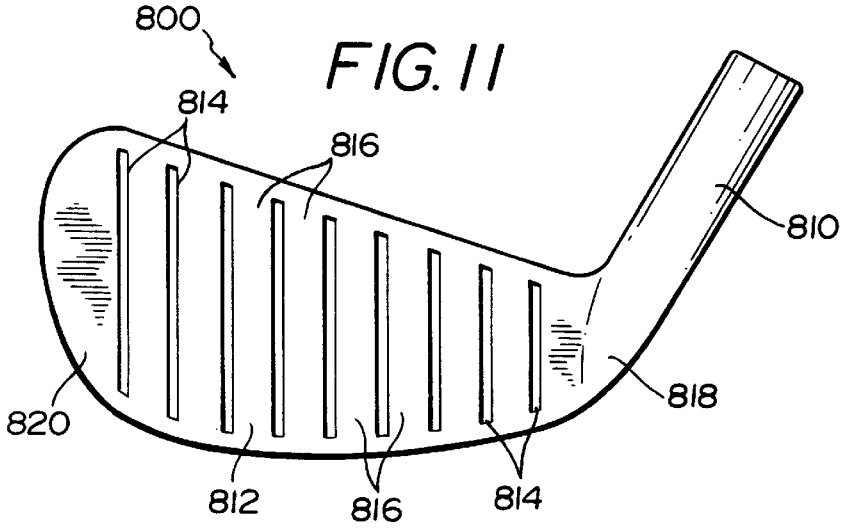
FIG. 11 is a front elevational view of a second embodiment of an iron type golf club head in accordance with the present invention.

FIG. 11 is a front elevational view of a second embodiment of an iron type golf club head 800 in accordance with the present invention including a hosel 810 and a ball striking face 812. A series of widely spaced vertical grooves 814 are located adjacent to and between cooperating wide land areas 816 on the ball striking face 812 between the heel 818 and toe 820.

Figure 12:
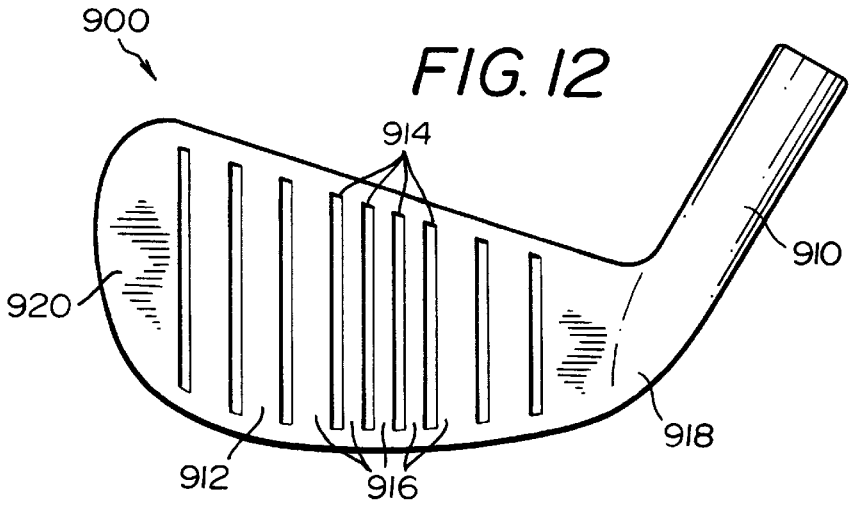
FIG. 12 is a front elevational view of a third embodiment of an iron type golf club head in accordance with the present invention.

FIG. 12 shows a third embodiment of an iron type golf club head 900 in accordance with the present invention including a hosel 10 and ball striking face 912. In this embodiment, a variety of grooves 914 and land areas 916 are disclosed located on the ball striking face 912 between the heel 918 and toe 920. As can be seen from the drawings, a series of four narrow grooves closely spaced between narrow land areas are disposed at the center of the ball striking face. Wider grooves spaced between wider land areas are located at the heel 918 and toe 920, respectively. It will be appreciated that a wide variety of narrow and wide grooves and narrow and wide land areas may be provided on a golf club ball striking face in keeping within the spirit and scope of the present invention. For example, the centrally located grooves can be narrow and closely spaced while the outward grooves progressively increase in width and/or as distance between each other, while being symmetrically positioned relative to the center of the club head.

Figure 13:
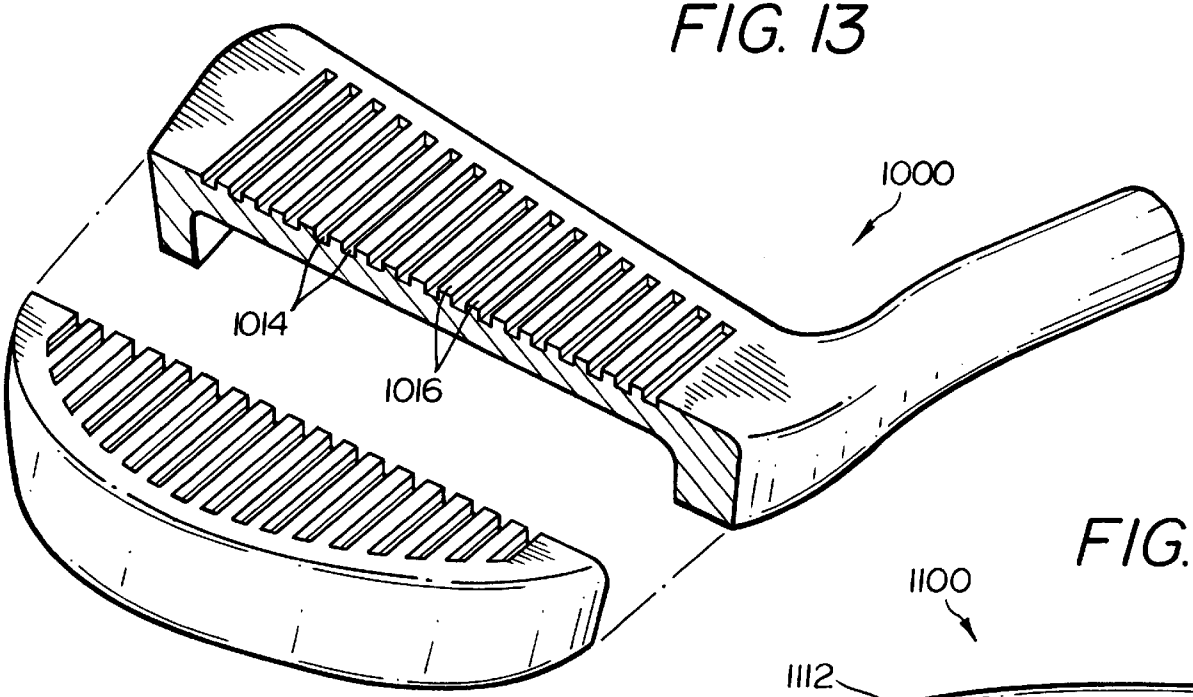
FIG. 13 is a perspective, exploded, sectional view of fourth embodiment of an iron type golf club head in accordance with the present invention.

FIG. 13 shows an exploded sectional view of a fourth embodiment of an iron type golf club head 1000 in accordance with the present invention. In this embodiment, a series of U-shape vertical grooves 1014 having equal widths and equal depths are show located adjacent to land areas 1016 having equal widths. As with the putter type golf club heads, it will be appreciated that a wide variety of groove configurations of the types shown in FIGS. 2 and 3 may be used in accordance with the present invention. For example, the iron type golf club heads may use V-shaped groove configurations of the type shown in FIG. 2, or may use the U-shaped groove configurations of the type shown in FIG. 3.

Figure 14:
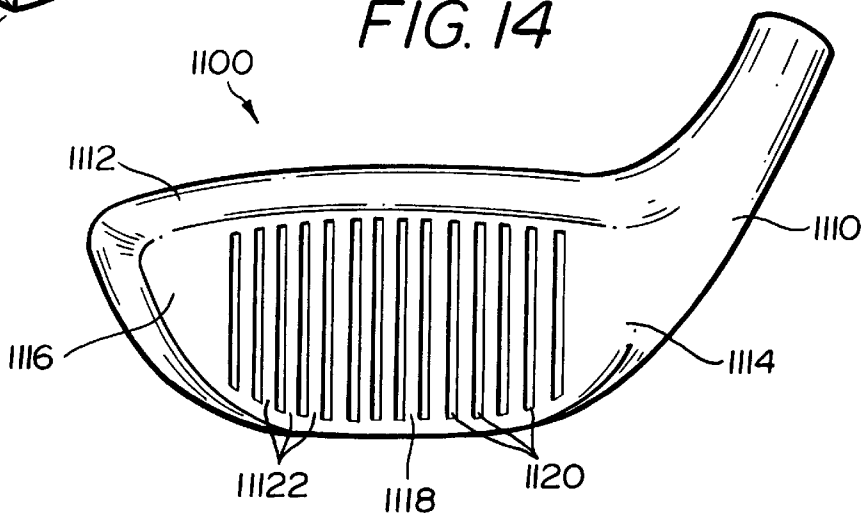
FIG. 14 is a front elevational view of a wood type golf club head in accordance with the present invention.

FIG. 14 discloses a first embodiment of a wood type golf club head 1100 in accordance with the present invention. The club head includes a hosel 1110 and a club head body 1112 having a heel 1114, toe 1116 and ball striking face 1118. A series of vertical grooves 1120 are equally spaced and adjacent to and between cooperating land areas 1122 having relatively narrow widths. Again, the grooves do not extend into the top and bottom of the club face but instead stop short of the top and bottom sections of horizontal land areas 1122, by approximately the same distance, so that generally horizontal land sections 1122 are formed adjacent the top and bottom of the club face. These horizontal lands 11222 are sufficiently large and strong to stabilize and secure the top and bottom sections of vertical lands 1122.

FIG. 15 shows a second embodiment of a wood type golf club head 1200 in accordance with the present invention. In this embodiment, a series of vertical grooves 1220 are widely spaced on a ball striking face 1218 adjacent to and between cooperating horizontal and vertical sections of land areas 1222 having relatively wide widths.

FIG. 16 shows a third embodiment of a wood type golf club head 1300 in accordance with the present invention. In this embodiment, a series of vertical grooves 1320 are disposed at various widths across the ball striking face 1318. As seen in the drawings, four centrally located vertical grooves 1320 are relatively close between relatively narrow land areas 1322, whereas vertical grooves 1320 located at the heel 1314 and at the toe 1316 are spaced relatively far apart between wide land areas 1322. In this and other embodiments, the centrally located grooves can be narrow and closely spaced while the outward grooves progressively increase in width as well as distance between each other, while being symmetrically positioned relative to the center of the club head.

FIG. 17 shows a sectional exploded view of a fourth embodiment of a wood type golf club head 1400 in accordance with the present invention. In this embodiment, a series of U-shape vertical grooves 1420 are positioned on a ball striking face 1418. The grooves 1420 have equal depth, and equal widths and the land areas 1422 have equal widths.

FIGS. 18 and 19 illustrate another embodiment of a putter type golf club head 1500 in accordance with the present invention having a separate insert 1502 located in the ball striking face 504. The insert 1502 is formed with an array of vertical land areas 1506 and adjacent the vertical grooves 1508 which function in a manner similar to the embodiments described hereinabove. The sectional view of FIG. 19 illustrates the insert 1502 wherein the vertical grooves are U-shaped and have the same width and depth. The land areas 1506 between the grooves 1508 are also equal in width.

Inserts such as that shown in FIGS. 18–19 can also be applied to iron and wood type club heads. Moreover, the inserts can be designed so that the vertical grooves in the face of the insert do not extend all the way to the top or bottom of the club face but instead fall short and form generally horizontal sections of lands 1506 adjacent the top and bottom of the insert. These horizontal sections of the lands preferably are sufficiently large and strong to stabilize the tops and bottoms of the vertical sections of lands. This overall configuration provides greater cushioning against shocks and vibrations and a formidable support to the club face giving it more strength for greater overall club head stability and control, when impacting the ball. In addition, such an embodiment should better control the range of the harmonics and resonance of the lands of metal between the grooves.

Figure 20:
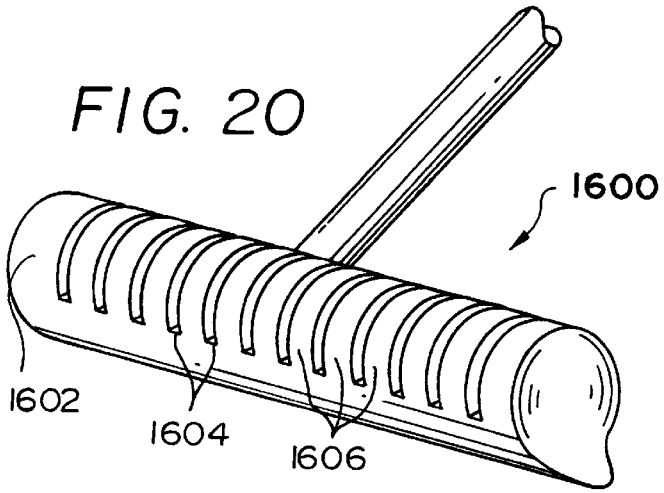
FIG. 20 is a perspective view of still another putter type golf club head in accordance with the present invention.
Figure 21:
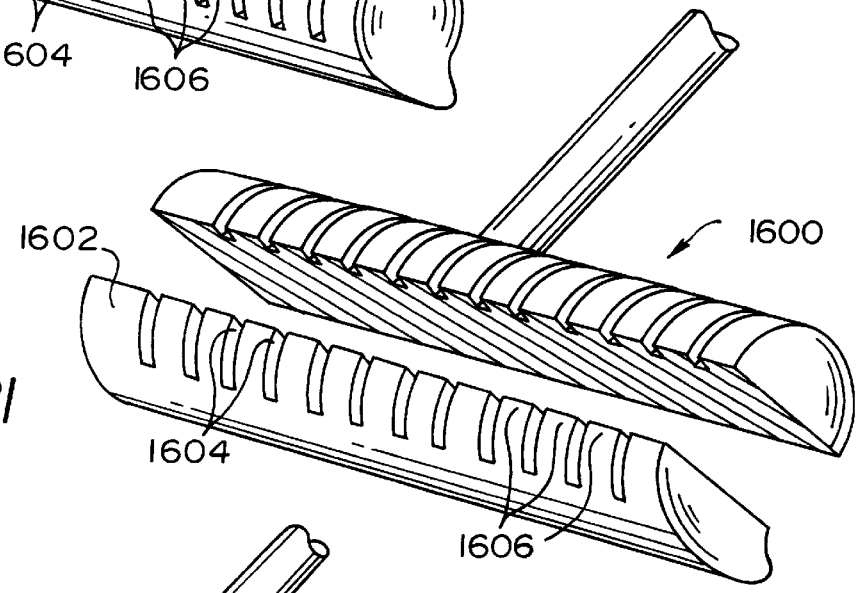
FIG. 21 is an exploded sectional view taken along the lines XI—XI of FIG. 20.

FIGS. 20 and 21 illustrates still another embodiment of a putter type golf club head 1600 in accordance with the present invention including a curved ball striking face 1602 having a series of vertical grooves 1604 positioned between vertical land area 1606. The grooves terminate at land areas at their respective tops and bottoms.

Figure 22:
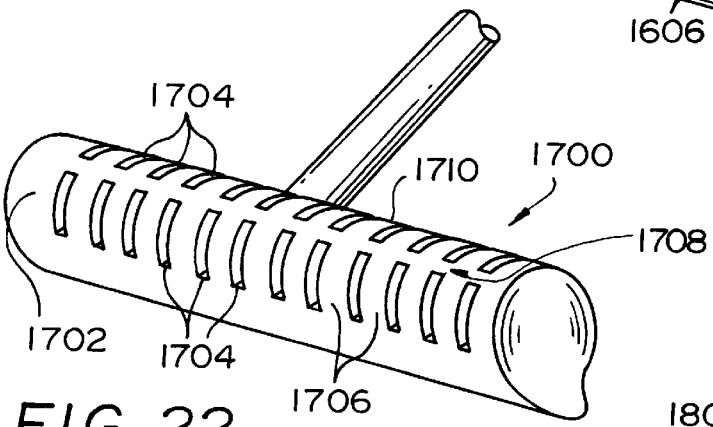
FIG. 22 is a front perspective view of an eighth embodiment of the putter of the present invention.

FIG. 22 shows a putter type golf club head 1700 having a curved ball striking face 1702 and a series of vertical grooves 1704 and vertical land areas 1706. An elongated, longitudinal land area forms a gap between upper and lower grooves 1704, the gap being positioned adjacent a top edge 1710 of the putter 1700. This intermediate longitudinal land area (and the others disclosed herein) is preferably sufficiently large and strong to stabilize and tie down or fix the ends of the vertical lands attached to it.

Figure 23:
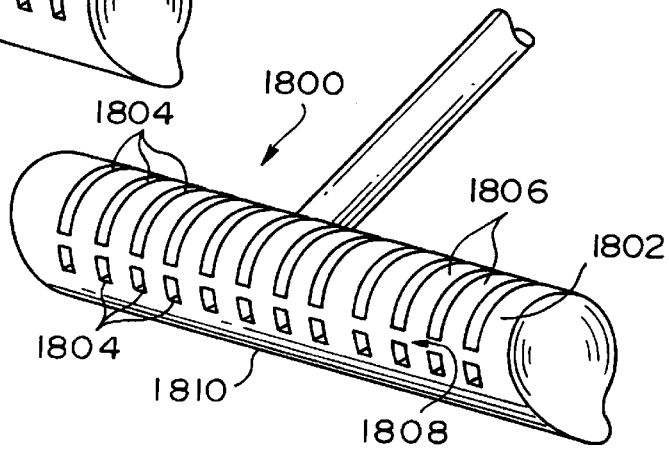
FIG. 23 is a front perspective view of a ninth embodiment of a putter of the present invention.

FIG. 23 shows a putter type golf club head 1800 having a curved ball striking face 1802 and a series of vertical grooves 1804 and vertical land areas 1806. An elongated, longitudinal land area 1808 forms a gap between upper and lower grooves 1804, the gap being positioned adjacent the bottom edge 1810 of the putter 1800.

FIG. 24 shows a putter type golf club head 1900 having a flat ball striking face 1902 having a series of grooves 1904 and land areas 1906. A longitudinal land area 1908 separates upper and lower portions of the grooves 1904 and is positioned adjacent a top surface 1910 of the putter 1900. This embodiment thus has three horizontal land areas, one at the top, one at the bottom, and one between. Preferably the land area 1908 is located at a position where a golf ball is most often struck.

FIG. 25 shows a putter type golf club head 2000 having a flat ball striking face 2002 and includes a series of grooves 2004 and land areas 2006. A longitudinal land area 2008 separates upper and lower portions of the grooves 2004 and is positioned adjacent a bottom surface 2010 of the putter 2000.

FIG. 26 shows a putter type golf club head 2100 including a flat ball striking face 2102, vertical grooves 2104 and land areas 2106. In this embodiment, two elongated longitudinal land areas 2108 and 2110 are provided separating the grooves 2104. The club head thus has four longitudinal land areas, each of which is generally horizontal.

FIG. 27 shows an embodiment of a putter type golf club head 2200 in accordance with the present invention including a triangular shaped hosel 2202 and a club head body 2204 having a ball striking face 2206 with a grid configuration formed of a single horizontal, elongated slot 2208 extending in a toe 2210 to heel 2212 direction and a series of vertical grooves 2214 extending through top surface 2222 and bottom sole 2224 and corresponding vertical land areas 2216 formed thereby and separated by the slot.

FIG. 28 illustrates an embodiment of a putter type golf club head 2300 in accordance with the present invention including a single stem hosel 2302 and club head body 2304 having a ball striking face 2306. A grid configuration is formed on the ball striking face 2306 with a series of raised land areas 2308 extending outwardly from the ball striking face 2306 and lying in a vertical direction when the club head 2300 is in a normal ball striking position relative to a support surface. The land areas 2308 are separated by an elongated horizontal slot 2310 running in a heel 2312 to toe 2314 direction.

FIG. 29 illustrates an embodiment of a putter type golf club head 2400 in accordance with the present invention and is similar to the embodiment shown in FIG. 28 with the exception that an elongated, horizontal slot 2410 is positioned toward the top ridge 2412 of a club head body 2404.

FIG. 30 illustrates an embodiment of a putter type golf club head 2500 in accordance with the present invention similar to the previous two embodiments wherein an elongated slot 2510 separates a series of vertical land areas 2508 and is located toward the bottom leading edge 2512 of the club head body 2504.

Figure 31:
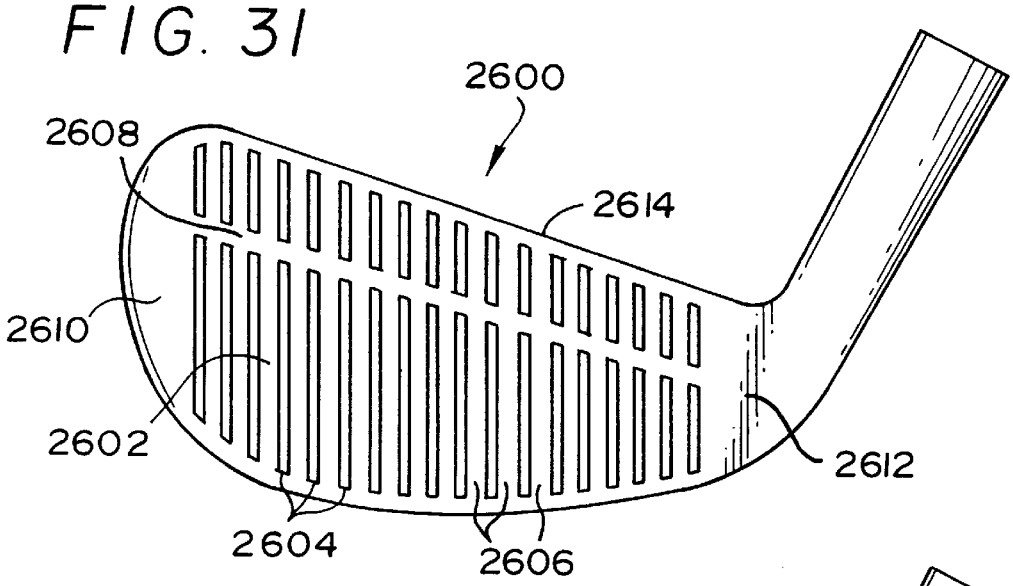
FIG. 31 is a front elevational view of a fifth embodiment of an iron type golf club in accordance with the present invention.

FIG. 31 shows an iron type golf club head 2600 having a ball striking face 2602 with vertical grooves 2604 and vertical land areas 2606. An elongated longitudinal land area 2608 separates the grooves 2604 and extends between the toe 2610 and heel 2612 of the club head 2600 adjacent the top ridge 2614. This particular land area 2608 is aligned with the top ridge of the golf club head. Such a longitudinal land area can be incorporated into any of the previously described groove and land systems for iron type club heads.

Figure 32:
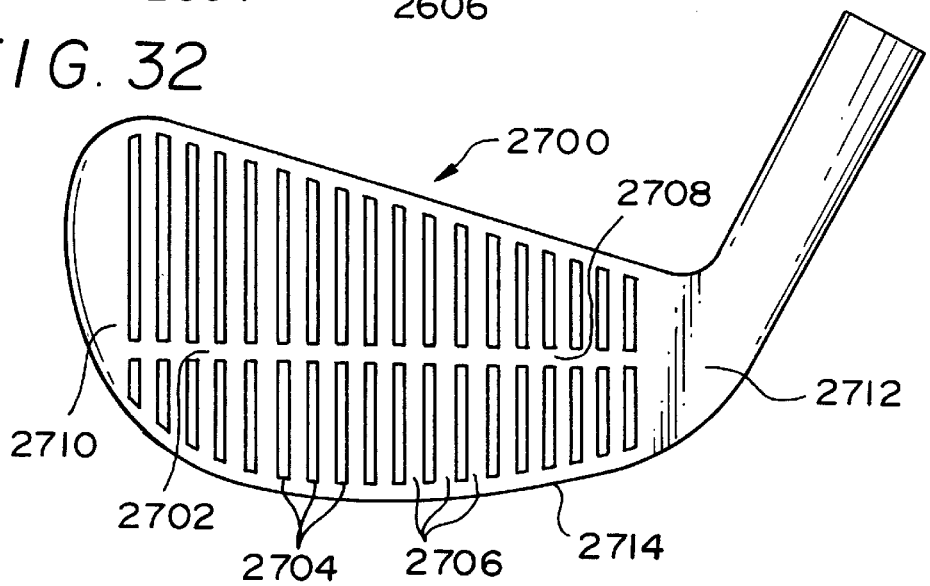
FIG. 32 is a front elevational view of a sixth embodiment of an iron type golf club in accordance with the present invention.

FIG. 32 shows an iron type golf club head 2700 having a ball striking face with vertical grooves 2704 and vertical land area 2706. An elongated longitudinal land area 2708 separates the grooves 2704 and extends between the toe 2710 and heel of the club head 2700 adjacent the bottom edge 2714 of the club head 2700. This land area is generally centrally located at the height where the center of a ball is generally hit. Again, this longitudinal land area can be incorporated into any of the previously described groove and land configurations.

Figure 33:
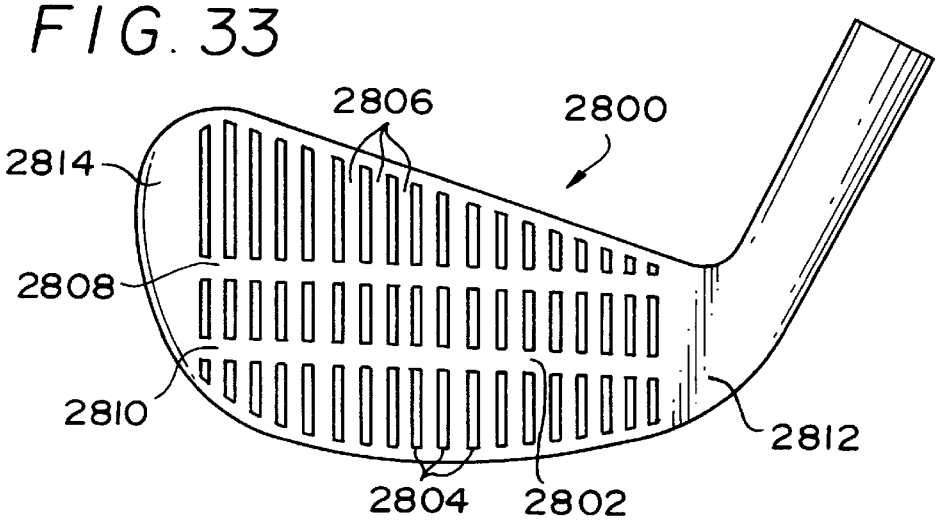
FIG. 33 is a front elevational view of a seventh embodiment of an iron type golf club in accordance with the present invention.

FIG. 33 shows an iron type golf club head 2800 including vertical grooves 2804, land areas 2806 and a pair of longitudinal land areas 2808, and 2810 separating the grooves 2804 and extending in a heel 2812 to toe 2814 direction. Such a pair of longitudinal lands can be incorporated into the various vertical groove and land designs previously described. Preferably all of the generally horizontal land areas disclosed herein are sufficiently large and strong to stabilize and securely hold in place the ends of the vertical lands that attach to these generally horizontal lands.

Figure 34:
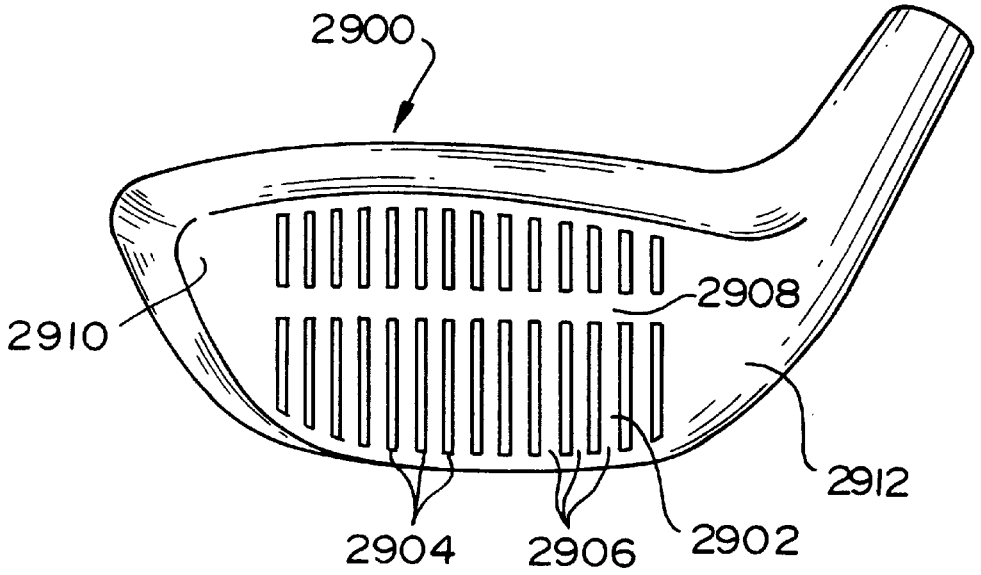
FIG. 34 is a fifth embodiment of a wood type golf club head in accordance with the present invention.

FIG. 34 shows a wood type golf club head 2900 including ball striking face 2902, vertical grooves 2904 and land areas 2906. A longitudinal land area 2908 extends between the toe 2910 and heel 2912 and separates the grooves 2904. This land is preferably positioned at the center height of the club slightly above the middle height of the club.

Figure 35:
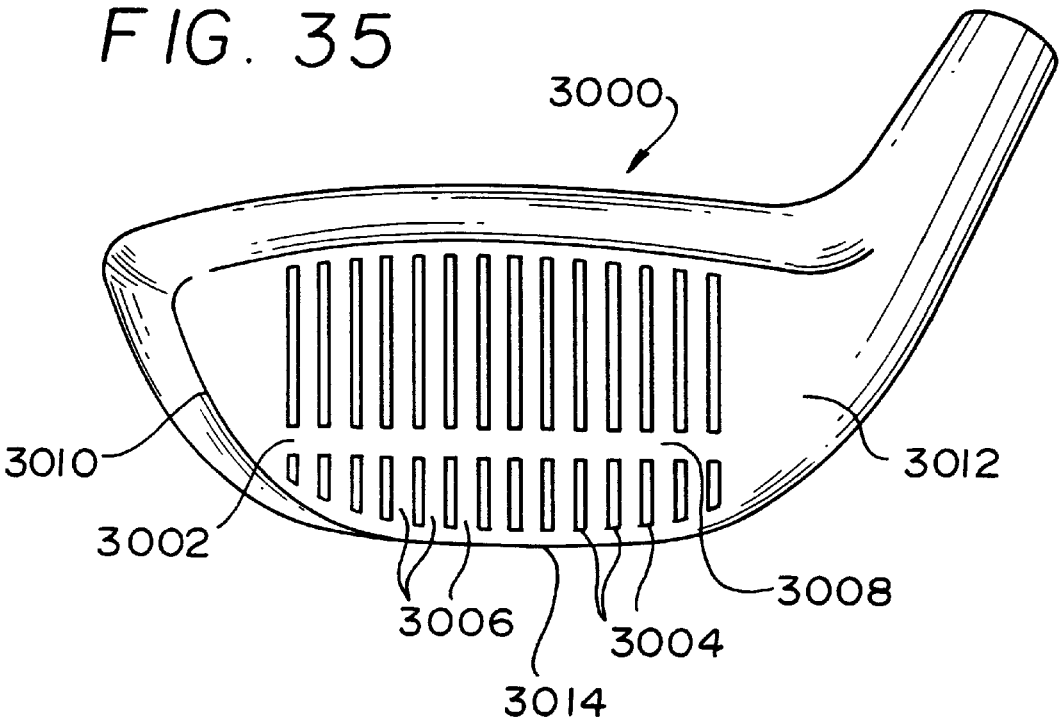
FIG. 35 is a sixth embodiment of a wood type golf club head in accordance with the present invention.

FIG. 35 shows a wood type golf club head 3000 including ball striking face 3002, vertical grooves 3004 and land areas 3006. In this embodiment, an elongated longitudinal land area 3008 extending between the toe 3010 and heel 3012, is located toward the bottom 3014 of the club head 3000.

The intermediate longitudinal lands illustrated in FIGS. 34 and 35 can be incorporated into any of the vertical groove and land configurations previously described for wood-type golf club heads. The resultant clubs would have a face with three longitudinal, generally horizontal lands, one at the top, one at the bottom, and one in the middle. These land areas help to control the resonance, frequency, and energy transferring characteristics of the lands and coordinated grooves. Each of the land areas are designed to provide optimum stability and club head control when ball contact occurs. This eliminates or minimizes possible distortions or damage to the club face from repeated high velocity swing speeds from certain caliber of golfers.

Figure 36:
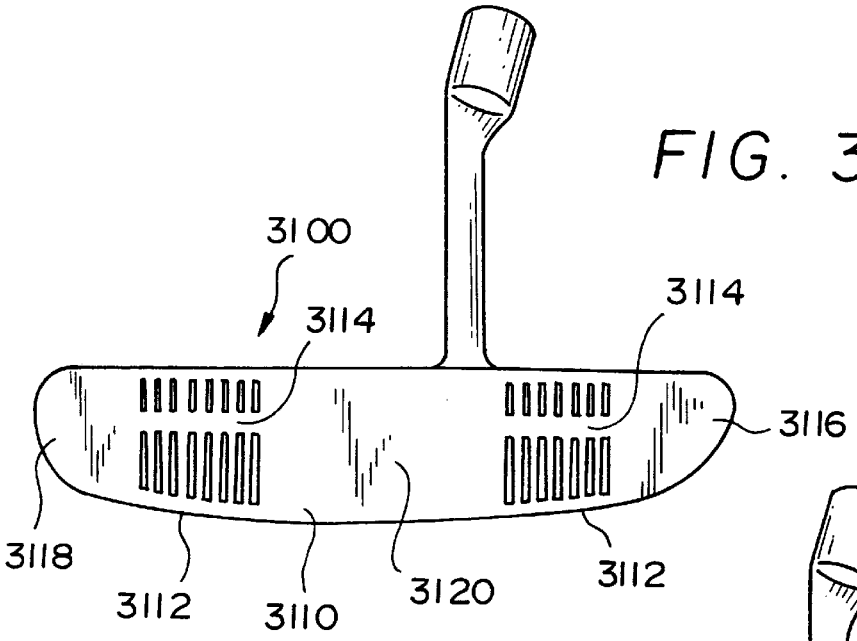
FIG. 36 is a front perspective view of a seventeenth embodiment of a putter in accordance with the present invention.

FIG. 36 shows a seventeenth embodiment of a putter type golf club head 3100 in accordance with the present invention. A ball striking face 3110 includes a series of vertical grooves 3112 adjacent the heel 3116 and toe 3118 respectively. The grooves 3112 are separated by generally horizontal land areas 3114. The center of the ball striking face 3110 is planar forming a single isolated, wide land area 3120 between the adjacent vertical grooves 3112. In this embodiment, the grooves 3112 act to dampen excess vibration, particularly if a golf ball is mis-hit.

Figure 37:
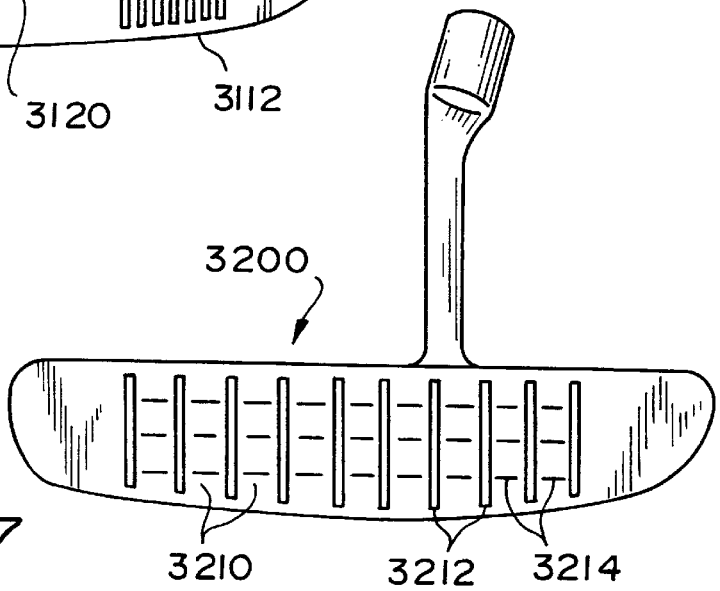
FIG. 37 is a front perspective view of an eighteenth embodiment of a putter in accordance with the present invention.

FIG. 37 illustrates an eighteenth embodiment of a putter type golf club head 3200 in accordance with the present invention in which an array of wide, isolated land areas 3210 and adjacent vertical grooves 3212 are spaced widely apart on the ball striking face approximately ¼ inch or 0.250 inches apart. Horizontal grooves 3214 are located between, but not touching, the vertical grooves 3212.

Figure 38:
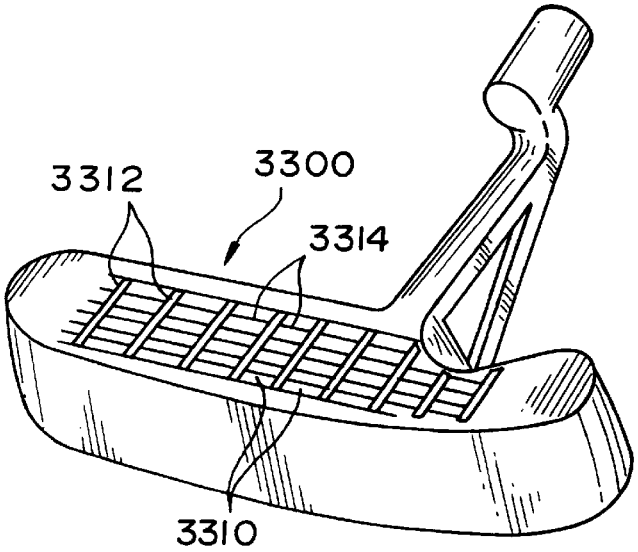
FIG. 38 is a front perspective view of a nineteenth embodiment of a putter in accordance with the present invention.

FIG. 38 illustrates a nineteenth embodiment of a golf club putter head 3300 in accordance with the present invention having a series of vertical land areas 3350 and adjacent grooves 3312. Horizontal grooves 3314 are located between and touching, the vertical grooves 3312.

Figure 39:
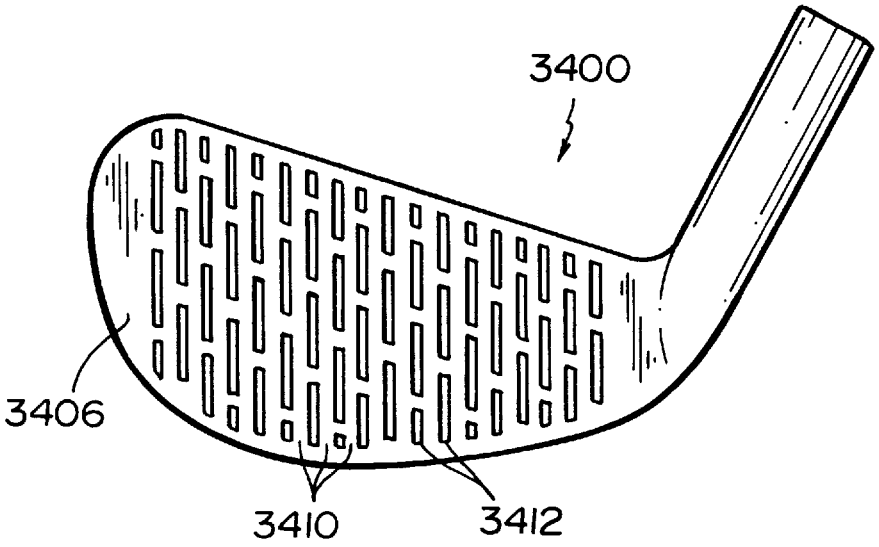
FIG. 39 is a front elevational view of an eighth embodiment of an iron type golf club head in accordance with the present invention.

FIG. 39 illustrates an iron type golf club head 3400 including a ball striking face 3406 having a series of vertical land areas 3410 separated by a series of broken grooves 3412.

Figure 40:
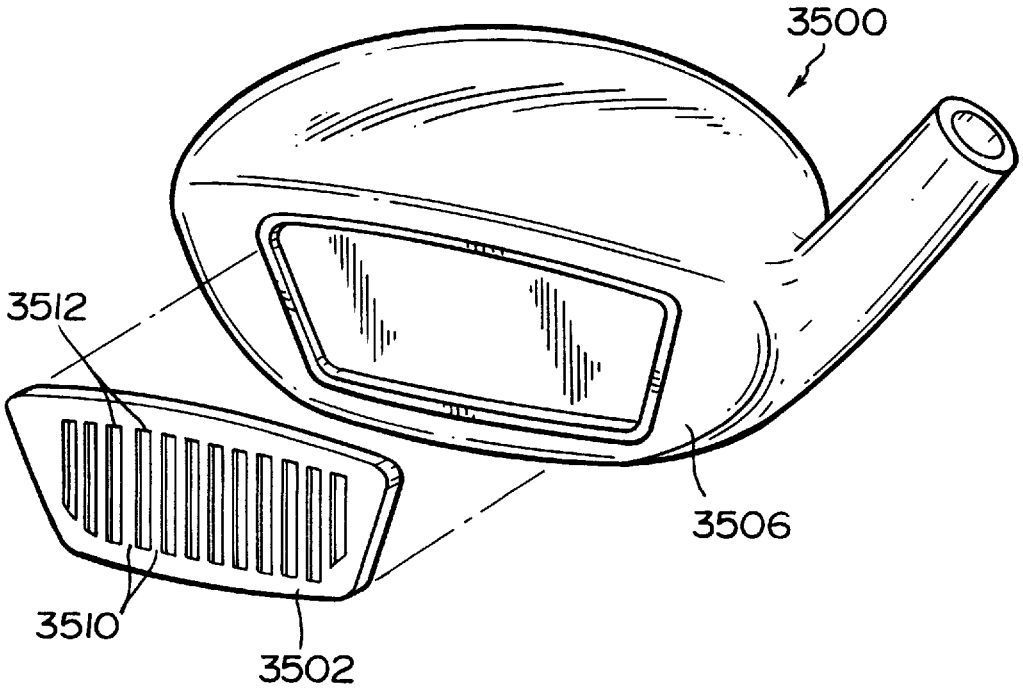
FIG. 40 is a front elevational view of a seventh embodiment of a wood type golf club head in accordance with the present invention.

FIG. 40 illustrates a wood type golf club head 3500 in accordance with the present invention having a separate insert 3502 located in the ball striking face 3506. The insert 3502 is formed with an array of vertical land areas 3510 and adjacent vertical grooves 3512 which function in a manner similar to the embodiment described herein above.

FIG. 41 shows a putter type golf club head 3600 having vertical land areas 3610 and vertical grooves 3612 and a single centrally located horizontal land area 3614 on the ball striking face 3616.

FIG. 42 shows another putter head 3700 having vertical land areas 3710, vertical grooves 3712 and two horizontal land areas 3714, 3716 on the ball striking face 3718 located adjacent the heel 3720 and toe 3722, respectively.

FIG. 43 illustrates a putter golf club head 3800 having vertical land areas 3810, vertical grooves 3812 and two angularly disposed land areas 3814, 3816 on the ball striking face 3818.

FIG. 44 illustrates a putter type golf club head 3900 having vertical land areas 3910, vertical grooves 3912 and a single arcuate land area 3914 on the ball striking face 3916 extending from the toe 3918 to the heel 3920.

It will be appreciated that the various configurations of horizontal land areas combined with the vertical groove structure of each of the putter heads described with respect of FIGS. 41–44 provide a different resonance characteristic creating a different feel when a golf ball is struck. The depth of the walls forming the vertical grooves will vary which affects the thickness, height and the width of adjacent land areas. The specifically required dimensions produce the preferred and desired harmonics feedback, along with the improved cushioning.

FIGS. 45–50 show iron type golf club heads having a variety of land area configurations combined with vertical grooves which also provide different resonance characteristics when the club head is used to strike a golf ball. The land areas disclosed in these embodiments can be incorporated into any of the previously disclosed vertical land and groove configurations. The various combinations of both vertical and horizontal land areas literally surround the vertical grooves on the club face of the respective club heads. This improvement produces increased cushioning for both irons and woods when swung at high-velocity swings.

Figure 45:
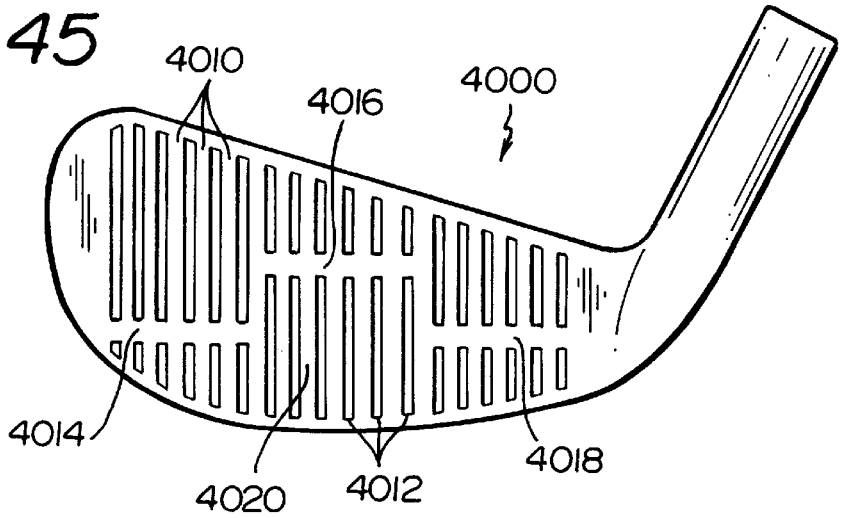
FIG. 45 is a front elevational view of a ninth embodiment of an iron type golf club head in accordance with the present invention.

FIG. 45 illustrates a golf club head 4000 having vertical land areas 4010, vertical grooves 4012 and three staggered horizontal land areas 4014, 4016 and 4018. In this embodiment, the centrally located horizontal land areas 4016 is disposed above the horizontal land areas 4014, 4018. The horizontal land areas separate the vertical grooves 4012 to create a variable resonance characteristic.

Figure 46:
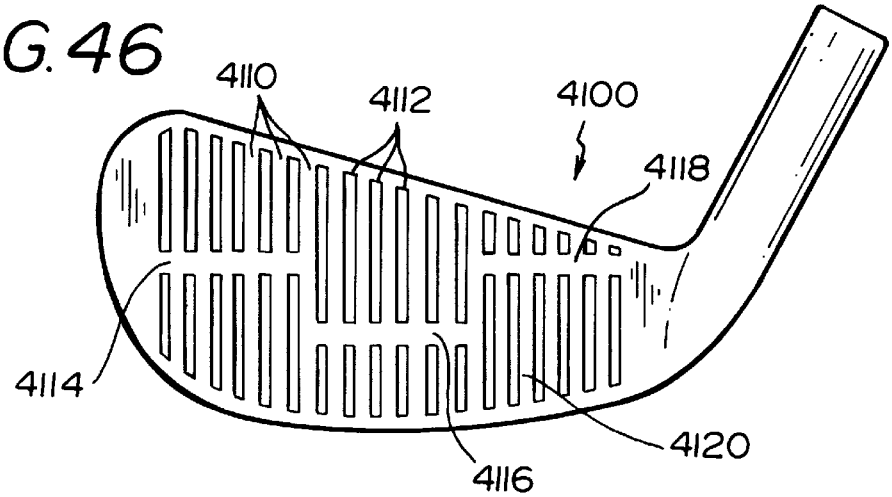
FIG. 46 is a front elevational view of a tenth embodiment of an iron type golf club head in accordance with the present invention.

FIG. 46 illustrates an iron type golf club head 410 including vertical land areas 4110, vertical grooves 4112, and three horizontal land areas 4114, 4116, 4118 on the ball striking face 4120. In this embodiment, the centrally located horizontal land area 4116 is below the horizontal land areas 4114, 4118.

Figure 47:
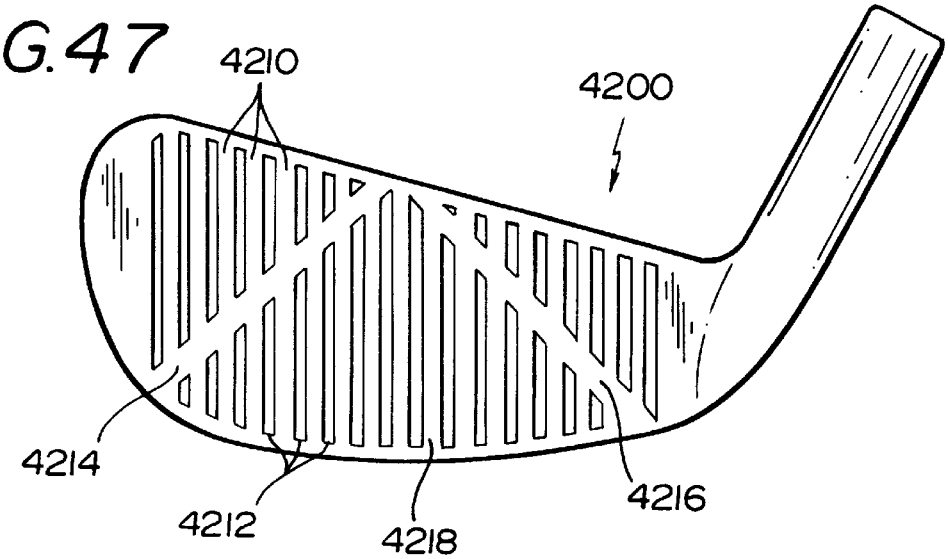
FIG. 47 is a front elevational view of a eleventh embodiment of an iron type golf club head in accordance with the present invention.

FIG. 47 shows an iron type golf club head 4200 including vertical land area 4210, vertical grooves 4212 and angularly disposed land areas 4214, 4216 on the ball striking face 4218.

Figure 48:
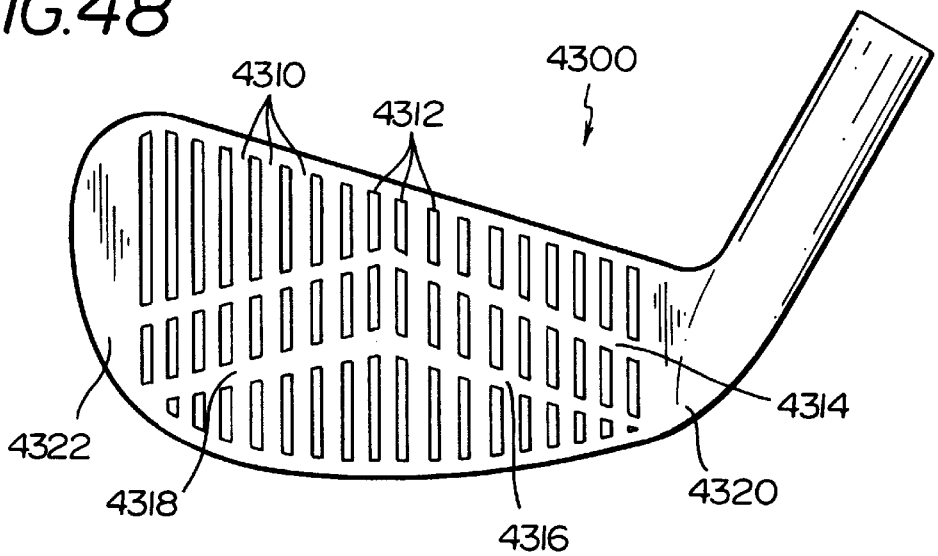
FIG. 48 is a front elevational view of a twelfth embodiment of an iron type golf club head in accordance with the present invention.

FIG. 48 shows an iron type golf club head 4300 having vertical land areas 4310 and vertical grooves 4312. In this embodiment, two angularly disposed land areas 4314, 4316 extend across the ball striking face 4318 from the heel 4320 to the toe 4322.

Figure 49:
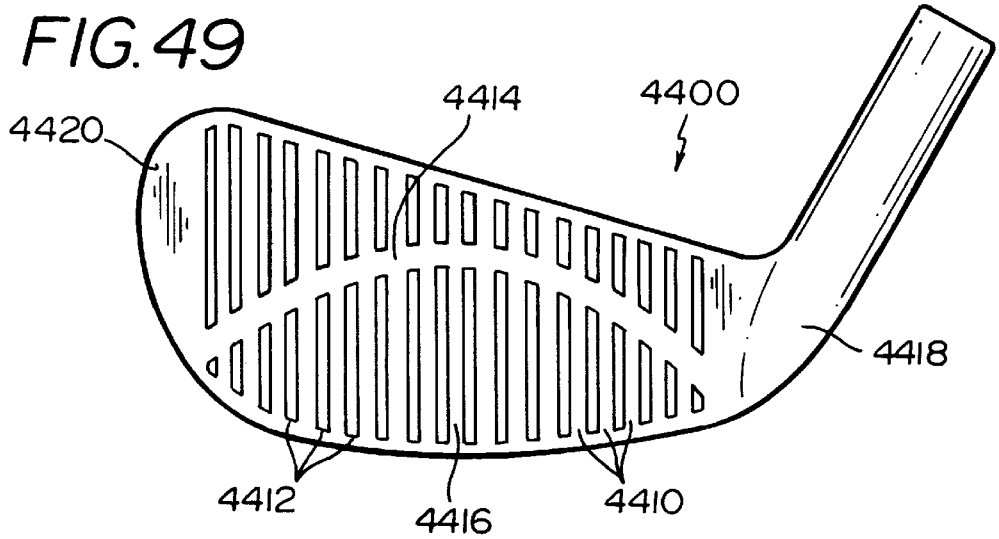
FIG. 49 is a front elevational view of a thirteenth embodiment of an iron type golf club head in accordance with the present invention.

FIG. 49 shows an iron type golf club head 4400 including vertical land areas 4410, vertical grooves 4412 and a singular arcuately shaped land area 4214 extending across the ball striking face 4416 between the heel 4418 and toe 4420.

Figure 50:
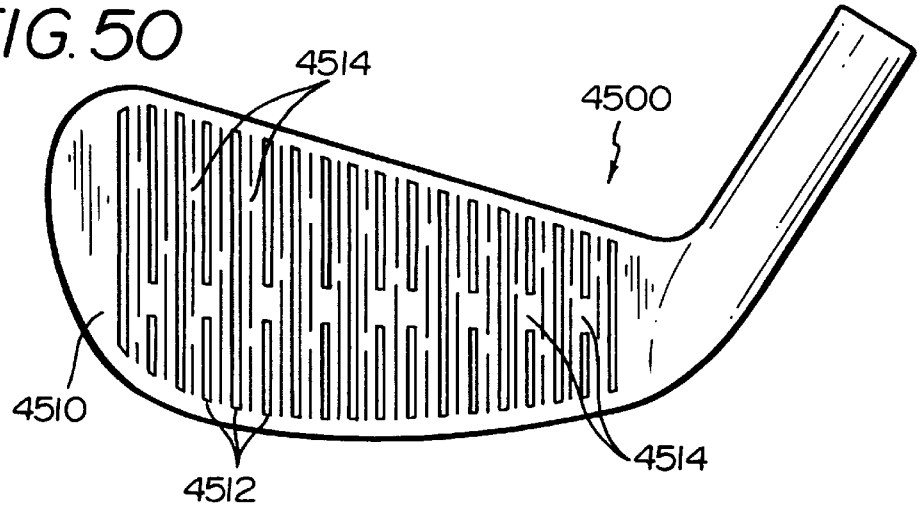
FIG. 50 is a front elevational view of a fourteenth embodiment of an iron type golf club head in accordance with the present invention.

FIG. 50 shows a golf club head 4500 having a ball striking face 4510 and a series of vertical grooves 4512 of various widths. Wider grooves have a width in the range of 0.040 to 0.060 which are flanked by grooves with lesser widths in the range of 0.020 to 0.040. Gaps 4514 separate both the wide and narrow grooves 4512 to provide a variety of resonance characteristics.

Figure 51:
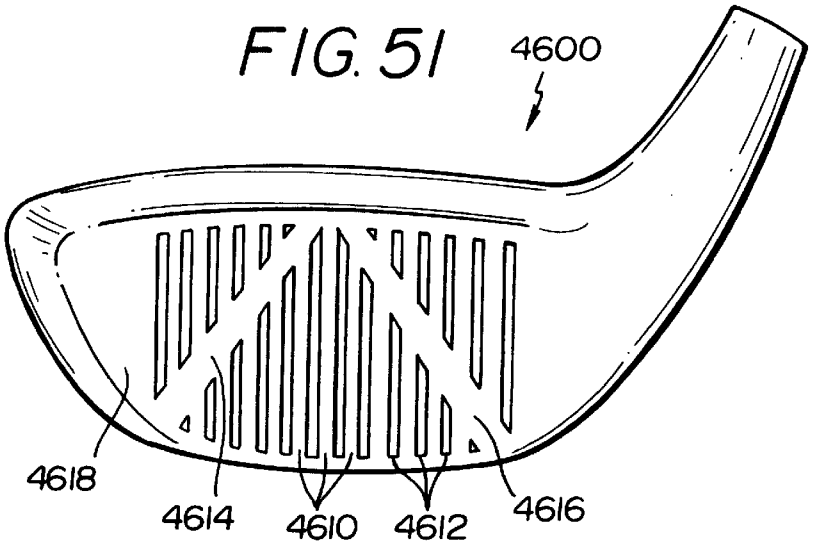
FIG. 51 is a front elevational view of a eighth embodiment of a wood type golf club head in accordance with the present invention.

FIG. 51 shows a wood type golf club head 4600 having series of vertical land areas 4610, vertical grooves 4612 and angularly disposed land areas 4614, 4616 on the ball striking face 4618. The land areas 4614 and 4616 separate the vertical grooves 4612 whereby a larger array of vertical grooves area adjacent the lower portion of the club face 4618.

Figure 52:
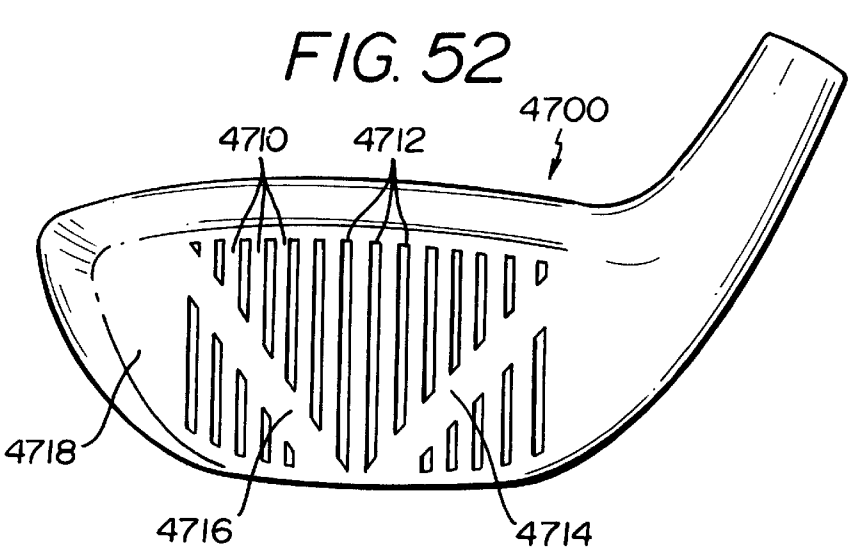
FIG. 52 is a front elevational view of a ninth embodiment of a wood type golf club head in accordance with the present invention.

FIG. 52 shows a wood type golf club head 4700 including vertically disposed land areas 4710, vertical grooves 4712 and angularly disposed 4714, 4716 on the ball striking face 4718. In this embodiment, the land areas 4714, 4716 separate the vertical grooves 4712 such that there is a larger array of vertical grooves adjacent the top portion of the ball striking face 4718.

Figure 53:
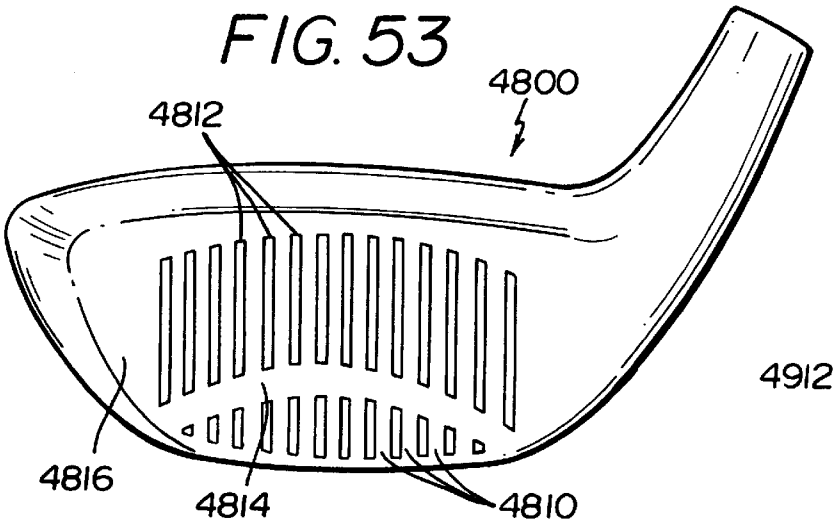
FIG. 53 is a front elevational view of a tenth embodiment of a wood type golf club head in accordance with the present invention.

FIG. 53 shows a wood type golf club head 4800 having vertical land areas 4810, vertical grooves 4812 and a single arcuate land area 4814 toward the lower portion of the ball striking face 4816.

Figure 54:
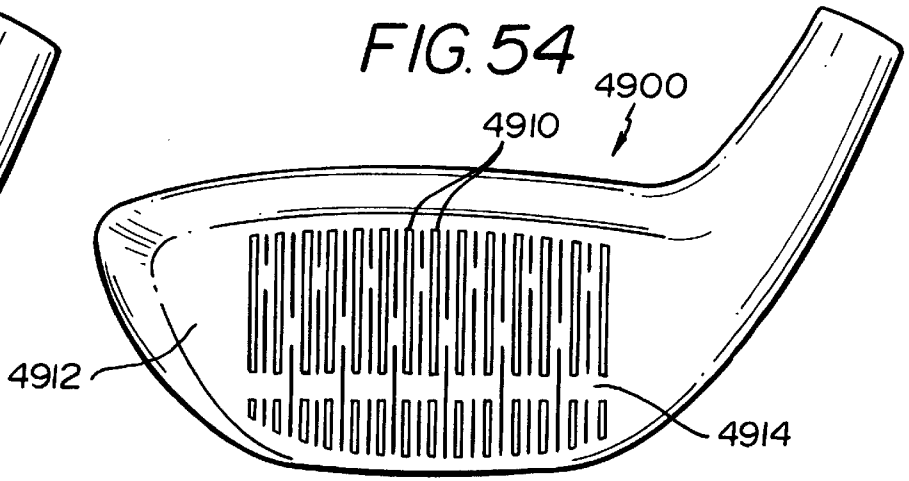
FIG. 54 is a front elevational view of a eleventh embodiment of a wood type golf club head in accordance with the present invention.

FIG. 54 illustrates a wood type golf club head 4900 having a series of different sized vertical grooves 4910 on the ball striking face 4912. This embodiment also includes a horizontal land area 4914 separating the vertical grooves 4910 toward the bottom of he ball striking face 4912.

The longitudinal land areas disclosed and described relative FIGS. 51–54 can be incorporated into any of the previously disclosed vertical groove and land configurations.

In certain preferred embodiments of the present invention, when applied to putter, iron, and wood type club heads, the vertical grooves and vertical land configurations are constructed and designed in a coordinated fashion such that at least some of the vertical land areas on a given club head have substantially different resonant characteristics than other vertical land areas on the same club head. As previously explained, the vertical land areas on the club face of the present invention are analogous to strings on a guitar or other string instrument, in that the vertical land areas will vibrate or resonate when the club head strikes a golf ball. The vibrational or resonant characteristics of a given vertical land area between two given vertical grooves of the present invention, will depend upon a variety of factors including but not limited to the length of the vertical land area, the width of the vertical land area, the depth of the vertical land area (defined by the depth of the walls of the adjacent grooves on the sides of the land area), and the manner in which the ends of the land area are either left free or are stabilized and held in place by a horizontal land area at its end. In certain preferred embodiments the resonant characteristics of at least two, and preferably more than two, of the vertical land areas for a given club head are varied relative to each other by changing one or more of these aspects of the different vertical land areas. By means of example, in some preferred embodiments the widths of at lest two, and preferably a plurality, of the vertical land areas differ from one another, while the lengths and the depths of the vertical land areas are the same or substantially the same. In other preferred embodiments the depths of at least two, and preferably a plurality, of the vertical land areas differ from one another (by having grooves with different depths), while the lengths of the widths of the vertical land areas are the same or substantially the same. In still other preferred embodiments, both the widths and depths of at least two, and preferably a plurality, of the vertical land areas differ from one another, wile the lengths of the vertical land areas are the same or substantially the same. In yet other embodiments, the lengths of at least two, and preferably a plurality, of the vertical land areas differ from one another, while the depths and widths are the same or substantially the same. In the preferred application of any of the above variations and others wherein different vertical land areas have different resonant characteristics, the top and bottom ends of the vertical lands are stabilized and effectively held in place, like the strings of a guitar, by horizontal land areas, as previously disclosed. In certain preferred embodiments, the vertical groove and land areas are configured so that the vertical land areas not only include land areas having different individual characteristics but also progressively vary in the characteristic from the general center of the club face outwardly. For example, the respective resonant frequencies of the different vertical land areas may progressively increase or decrease, from the center outwardly.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas being parallel to and non-intersecting with adjacent vertical grooves;

said land areas having specific width dimensions and said grooves having specific width and depth dimensions;

said plurality of vertical grooves and said vertical land areas terminating short of said surrounding peripheral land area at said lower surface and said upper surface of the club head;

at least one land area formed between said heel and said toe on said ball striking face, intersecting and separating said vertical grooves and said vertical land areas into upper and lower vertical groove and vertical land sections.

2. The club head of claim 1, wherein said grooves are shallow V-shaped grooves, each groove having a depth less than 0.020 inch.

3. The club head of claim 1, wherein said grooves are deep V-shaped grooves, each groove having a depth of or greater than 0.020 inch.

4. The club head of claim 1, wherein said grooves are shallow V-shaped grooves, each groove having a depth less than 0.020 inch.

5. The club head of claim 1, wherein said grooves are deep U-shaped grooves each having a depth of or greater than 0.020 inch.

6. The club head of claim 1, wherein said grooves are a combination of deep and shallow grooves.

7. The club head of claim 1, wherein the grooves have the same width as the width of the land areas between said grooves.

8. The club head of claim 1, wherein the land areas between said grooves are at least three times the width of said grooves.

9. The club head of claim 1, wherein said grooves are a combination of wide and narrow widths.

10. The club head of claim 1, wherein the land area widths are less than 0.060 inch.

11. The club head of claim 10, wherein the land area widths are in the range of 0.020 to 1.000 inch.

12. The club head of claim 1, wherein the groove widths are less than 0.060 inch.

13. The club head of claim 1, wherein the depths of said grooves are less than 0.060 inch.

14. The club head of claim 1 wherein the widths of the land areas are the same as the widths of said grooves.

15. The club head of claim 1 wherein said ball striking face is curved.

16. The club head of claim 1 wherein said ball striking face is formed with an insert and said grooves are formed in said insert.

17. The club head of claim 1 wherein said club head is a putter.

18. The club head of claim 1 wherein said club head is an iron type golf club head.

19. The club head of claim 1 wherein said club head is a wood type golf club head.

20. The club head of claim 1 wherein said vertical grooves are shallow, V-shaped grooves and have a width less than 0.035 inch.

21. The club head of claim 1 wherein said vertical grooves are deep V-shaped grooves and have a width less than 0.035 inch.

22. The club head of claim 1 wherein said vertical grooves are shallow, V-shaped grooves and have a width greater than 0.035 inch.

23. The club head of claim 1 wherein said vertical grooves are deep V-shaped grooves and have a width greater than 0.035 inch.

24. The club head of claim 1 wherein said vertical grooves are shallow, U-shaped grooves and have a width less than 0.035 inch.

25. The club head of claim 1 wherein said vertical grooves are deep U-shaped grooves and have a width less than 0.035 inch.

26. The club head of claim 1 wherein said vertical grooves are shallow, U-shaped grooves and have a width greater than 0.035 inch.

27. The club head of claim 1 wherein said vertical grooves are deep U-shaped grooves and have a width greater than 0.035 inch.

28. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas having specific width dimensions and said grooves having specific width and depth dimensions;

said land areas being parallel to and non-intersecting with adjacent vertical grooves;

said plurality of vertical grooves and said vertical land areas terminating short of said surrounding peripheral land area at said lower surface and said upper surface of the club head;

said club head being further defined by said vertical land areas of said arrangement of vertical grooves and vertical land areas having a greater width than the width of said vertical grooves;

and, a resonator formed by said arrangement of vertical grooves and said vertical land areas, said resonator producing a low resonance frequency of vibration when the ball striking face impacts a golf ball; wherein a specific frequency of said low resonance frequency of vibration is determined by the coordinated, variable dimensional relationship of said vertical grooves and said vertical land areas.

29. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas having specific width dimensions and said grooves having specific width and depth dimensions;

said land areas being parallel to and non-intersecting with adjacent vertical grooves;

said plurality of vertical grooves and said vertical land areas terminating short of said surrounding peripheral land areas at said lower surface and said upper surface of the club head;

said club head being further defined by said vertical land areas of said arrangement of vertical grooves and vertical land areas having a lesser width than the width of said vertical grooves;

and, a resonator formed by said arrangement of vertical grooves and said vertical land areas, said resonator producing a high resonance frequency of vibration when the ball striking face impacts a golf ball; wherein a specific frequency of said high resonance frequency of vibration is determined by the coordinated, variable dimensional relationship of said vertical grooves and said vertical land areas.

30. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas being parallel to and non-intersecting with adjacent vertical grooves;

said land areas having specific width dimensions and said grooves having specific width and depth dimensions;

said plurality of vertical grooves and said vertical land areas terminating short of said surrounding peripheral land area at said lower surface and said upper surface of the club head;

at least one elongated horizontal land area formed in a lateral direction between said heel and said toe on said ball striking face, intersecting and separating said vertical grooves and said vertical land areas into upper and lower vertical groove and vertical land sections;

and, a resonator formed by said vertical grooves and said land areas, said resonator producing a given frequency resonance when the ball striking face impacts a golf ball; said given frequency being determined by the coordinated, variable dimensional relationship of said grooves and said land areas.

31. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land area s being parallel to and non-intersecting with adjacent vertical grooves;

said land areas having specific width dimensions and said grooves having specific width and depth dimensions;

said plurality of vertical grooves and said vertical land areas terminating short of said surrounding peripheral land area at said lower surface and said upper surface of the club head;

at least one angularly disposed land area formed between said heel and said toe on said ball striking face, intersecting and separating said vertical grooves and said vertical land areas into upper and lower vertical groove and vertical land sections;

and, a resonator formed by said vertical grooves and said l and areas, said resonator producing a given frequency resonance when the ball striking face impacts a golf ball; said given frequency being determined by the coordinated, variable dimensional relationship of said grooves and said land areas.

32. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas being parallel to and non-intersecting with adjacent vertical grooves;

said land areas having specific width dimensions and said groove s having specific width and depth dimensions;

said plurality of vertical grooves and said vertical land areas terminating short of said surrounding peripheral land area at said lower surface and said upper surface of the club head;

at least one arcuately shaped land area formed between said heel and said toe on said ball striking face, intersecting and separating said vertical grooves and said vertical land areas into upper and lower vertical groove and vertical land sections;

and, a resonator formed by said vertical grooves and said land areas, said resonator producing a given frequency resonance when the ball striking face impacts a golf ball; said given frequency being determined by the coordinated, variable dimensional relationship of said grooves and said land areas.

33. A golf club head including a club head body having a heel, toe, lower surface, upper surface, rear surface and ball striking face having a surrounding peripheral land area wherein the improvement comprises:

a plurality of parallel vertical grooves on said ball striking face oriented generally in a direction perpendicular to said upper surface and said lower surface of said club head;

an array of vertical land areas separating said vertical grooves, said vertical land areas also formed in a perpendicular direction between said upper and lower surfaces;

said land areas having specific width dimensions and said grooves having specific width and depth dimensions;

said land areas being parallel to and non-intersecting with adjacent vertical grooves;

said plurality of vertical grooves and said vertical land areas terminating short of said surrounding peripheral land area at said lower surface and said upper surface of the club head;

said club head being further defined by said vertical land areas of said arrangement of vertical grooves and vertical land areas having a width of at least three times greater than the width of said vertical grooves.

* * * * *